US011464256B2

(12) United States Patent
Beer et al.

(10) Patent No.: US 11,464,256 B2
(45) Date of Patent: Oct. 11, 2022

(54) CASE FOR AN ELECTRONIC SMOKING DEVICE

(71) Applicant: Fontem Holdings 1 B.V., Amsterdam (NL)

(72) Inventors: Andreas Beer, Grasbrunn (DE); Stefan Biel, Hamburg (DE)

( * ) Notice: Subject to any disclaimer, the term of this patent is extended or adjusted under 35 U.S.C. 154(b) by 55 days.

(21) Appl. No.: 16/330,066

(22) PCT Filed: Sep. 6, 2017

(86) PCT No.: PCT/EP2017/072328
§ 371 (c)(1),
(2) Date: Mar. 1, 2019

(87) PCT Pub. No.: WO2018/046533
PCT Pub. Date: Mar. 15, 2018

(65) Prior Publication Data

US 2021/0378297 A1 Dec. 9, 2021

(30) Foreign Application Priority Data

Sep. 6, 2016 (EP) ..... 16187504
Sep. 14, 2016 (EP) ..... 16188839

(51) Int. Cl.
*A24F 40/48* (2020.01)
*A24F 15/015* (2020.01)
*A24F 40/42* (2020.01)

(52) U.S. Cl.
CPC ..... *A24F 15/015* (2020.01); *A24F 40/48* (2020.01); *A24F 40/42* (2020.01)

(58) Field of Classification Search
CPC ..... A24F 40/48
See application file for complete search history.

(56) References Cited

U.S. PATENT DOCUMENTS

2014/0209109 A1 7/2014 Larson
2015/0245654 A1* 9/2015 Memari ..... H05K 999/99 141/2
2018/0200458 A1* 7/2018 Li ..... A24F 40/46
2019/0208811 A1* 7/2019 Biel ..... A24F 40/485
(Continued)

FOREIGN PATENT DOCUMENTS

CN 203633509 U 6/2014
CN 204015101 U 12/2014
CN 104540784 A 4/2015
(Continued)

*Primary Examiner* — James Harvey
(74) *Attorney, Agent, or Firm* — Dykema Gossett, PLLC

(57) ABSTRACT

It is provided a case (200) for an electronic smoking device (10). The case (200) comprises a primary receiving portion (101), adapted to receive an electronic smoking device (10) and a secondary receiving portion (102), adapted to receive a liquid cartridge (300), adapted to contain a liquid. Furthermore, the case (200) comprises a liquid channel system (110) for the transport of liquid within the case (200). Moreover, the case (200) comprises a pump system (120) with an actuation element (130), adapted to provide liquid from a liquid cartridge (300) received by the secondary receiving portion (102) to a liquid outlet (112) of the liquid channel system (110) via the liquid channel system (110) upon an actuation of the actuation element (130).

15 Claims, 24 Drawing Sheets

(56) References Cited

U.S. PATENT DOCUMENTS

2021/0378297 A1* 12/2021 Beer ..... A24F 15/015

FOREIGN PATENT DOCUMENTS

| | | | |
|---|---|---|---|
| CN | 104872820 | A | 9/2015 |
| CN | 204994614 | U | 1/2016 |
| CN | 105533811 | A | 5/2016 |
| DE | 102007036319 | A1 | 2/2009 |
| GB | 2523585 | A | 9/2015 |
| WO | 2016096337 | A1 | 6/2016 |

* cited by examiner

CASE FOR AN ELECTRONIC SMOKING DEVICE

FIELD OF INVENTION

The present invention relates generally to electronic smoking devices and in particular to electronic cigarettes.

BACKGROUND OF THE INVENTION

An electronic smoking device, such as an electronic cigarette (e-cigarette), typically has a housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic cigarettes, an airflow sensor is provided within the electronic smoking device, which detects a user puffing on the device (e.g., by sensing an underpressure or an air flow pattern through the device). The airflow sensor indicates or signals the puff to the control electronics to power up the device and generate vapor. In other e-cigarettes, a switch is used to power up the e-cigarette to generate a puff of vapor.

Most electronic smoking devices are configured to be refilled when the liquid reservoir of the electronic smoking device is emptied. Often, a procedure for the refill of the liquid reservoir of an electronic smoking device comprises a disassembling of the electronic smoking device in order to expose a refill opening of the liquid reservoir of the electronic smoking device. In most cases, a refill bottle is used to refill the liquid reservoir, wherein the refill bottles of the state of the art mostly comprise a simple pipette like attachment or cap which shall allow for liquid to be transported from the refill bottle into the liquid reservoir via the refill opening.

However, such refill bottles with attachments or caps like the aforementioned often cause the liquid to spill during the refill procedure which can be perceived as highly inconvenient for the user of the electronic smoking device. Furthermore, when refilling the liquid reservoir, it is necessary to avoid dripping liquid into the air tube. Liquid that passes down the air tube into the atomizer may flood the atomizer and temporarily stops the device from working. When the device is then operated to clear the misplaced liquid, this often results in leakage as the misplaced liquid finds its way out of the atomizer through the air passage. Clearing the air passage is also often accompanied by a "gurgling" sound and sensation which users find unpleasant. Moreover, difficulties in refilling an electronic smoking device may cause users to miss the reservoir causing their fingers holding the electronic smoking device to come into contact with the liquid for atomization. Further liquid may spill from the reservoir prior to the mouthpiece of the device being reattached closing the open end of the reservoir. Often liquid for atomization is relatively greasy and is impregnated with flavors which makes coming into contact unpleasant and undesirable as the liquid needs to be washed off and odors from the liquid may be retained on the hands. Furthermore, there is a risk that users may accidentally ingest the liquid if the liquid is not washed off.

In general, the refill systems of the state of the art often are difficult to handle and do not allow for a quick and easy refill. Furthermore, they are often realized as a component that is separated from the electronic smoking device itself and that additionally has to be transported and stored which may be inconvenient to the user of the electronic smoking device.

SUMMARY OF THE INVENTION

In accordance with one aspect of the present invention, there is provided a case for an electronic smoking device. The case comprises a primary receiving portion that is adapted to receive an electronic smoking device. Furthermore, the case comprises a secondary receiving portion, adapted to receive a liquid cartridge that is adapted to contain a liquid and a liquid channel system for the transport of liquid within the case. The liquid channel system comprises a liquid inlet that is adapted to be connected to a liquid cartridge received by the secondary receiving portion, a liquid outlet and a liquid channel component, interconnecting the liquid inlet and the liquid outlet. Furthermore, the case comprises a pump system with an actuation element, adapted to provide liquid from a liquid cartridge received by the secondary receiving portion to the liquid outlet via the liquid channel system upon an actuation of the actuation element.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DESCRIPTION OF THE PREFERRED EMBODIMENTS

Figure 1:
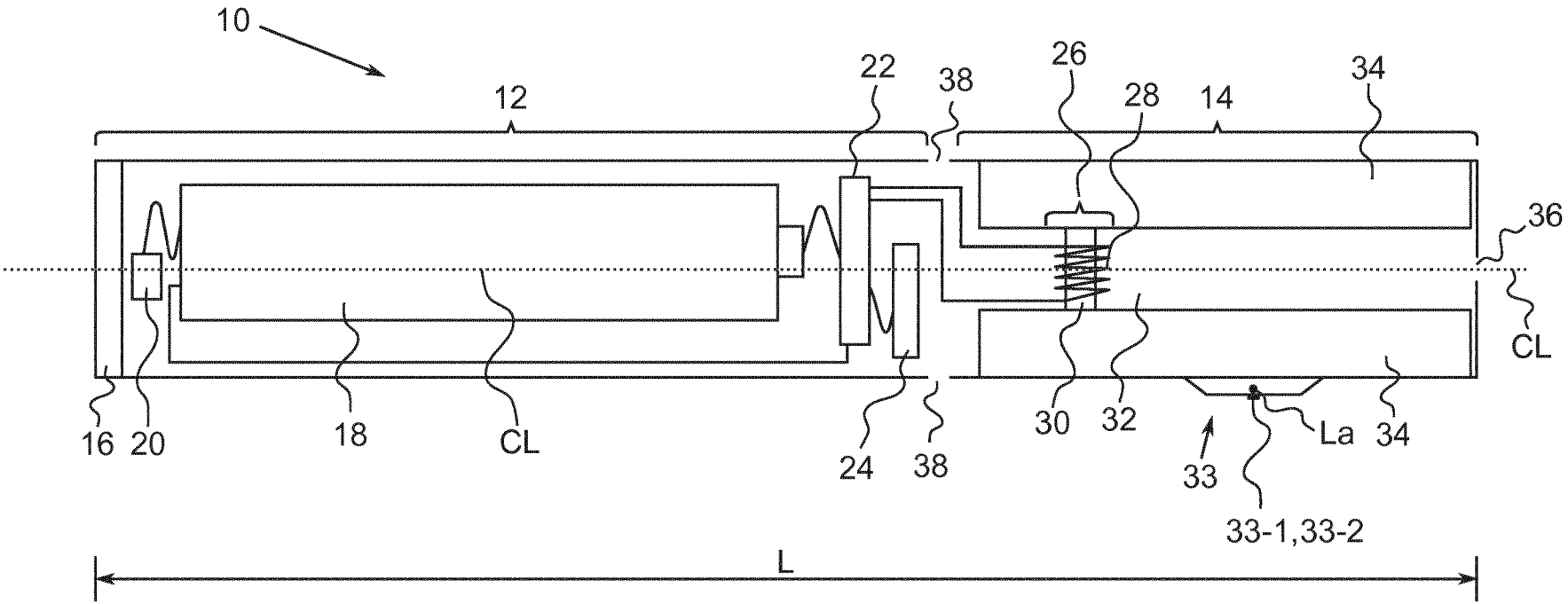
FIG. 1 is a schematic cross-sectional illustration of an exemplary electronic smoking device for a first embodiment of a case.

Throughout the following, an electronic smoking device that can be used with an embodiment of a case described hereinafter will be exemplarily described with reference to an e-cigarette. As is shown in FIG. 1, an e-cigarette 10 typically has a housing comprising a cylindrical hollow tube having an end cap 16. The cylindrical hollow tube may be a single-piece or a multiple-piece tube. In FIG. 1, the cylindrical hollow tube is shown as a two-piece structure having a power supply portion 12 and an atomizer/liquid reservoir portion 14. Together the power supply portion 12 and the atomizer/liquid reservoir portion 14 form a cylindrical tube which can be approximately the same size and shape as a conventional cigarette, typically about 100 mm with a 7.5 mm diameter, although lengths may range from 70 to 150 or 180 mm, and diameters from 5 to 28 mm.

The power supply portion 12 and atomizer/liquid reservoir portion 14 are typically made of metal, e.g. steel or aluminum, or of hardwearing plastic and act together with the end cap 16 to provide a housing to contain the components of the e-cigarette 10. The power supply portion 12 and an atomizer/liquid reservoir portion 14 may be configured to fit together by a friction push-fit, a snap-fit, or a bayonet attachment, magnetic-fit, or screw threads. The end cap 16 is provided at the front end of the power supply portion 12. The end cap 16 may be made from translucent plastic or other translucent material to allow a light-emitting diode (LED) 20 positioned near the end cap to emit light through the end cap. The end cap can be made of metal or other materials that do not allow light to pass.

An air inlet may be provided in the end cap, at the edge of the inlet next to the cylindrical hollow tube, anywhere along the length of the cylindrical hollow tube, or at the connection of the power supply portion 12 and the atomizer/liquid reservoir portion 14. FIG. 1 shows a pair of air inlets 38 provided at the intersection between the power supply portion 12 and the atomizer/liquid reservoir portion 14.

A power supply, preferably a battery 18, an LED 20, control electronics 22 and optionally an airflow sensor 24 are provided within the cylindrical hollow tube power supply portion 12. The battery 18 is electrically connected to the control electronics 22, which are electrically connected to the LED 20 and the airflow sensor 24. In this example, the LED 20 is at the front end of the power supply portion 12, adjacent to the end cap 16 and the control electronics 22 and airflow sensor 24 are provided in the central cavity at the other end of the battery 18 adjacent the atomizer/liquid reservoir portion 14.

The airflow sensor 24 acts as a puff detector, detecting a user puffing or sucking on the atomizer/liquid reservoir portion 14 of the e-cigarette 10. The airflow sensor 24 can be any suitable sensor for detecting changes in airflow or air pressure, such as a microphone switch including a deformable membrane which is caused to move by variations in air pressure. Alternatively, the sensor may be a Hall element or an electro-mechanical sensor.

The control electronics 22 are also connected to an atomizer 26. In the example shown, the atomizer 26 includes a heating coil 28 which is wrapped around a wick 30 extending across a central passage 32 of the atomizer/liquid reservoir portion 14. The coil 28 may be positioned anywhere in the atomizer 26 and may be transverse or parallel to the liquid reservoir 34. The wick 30 and heating coil 28 do not completely block the central passage 32. Rather an air gap is provided on either side of the heating coil 28 enabling air to flow past the heating coil 28 and the wick 30. The atomizer may alternatively use other forms of heating elements, such as ceramic heaters, or fiber or mesh material heaters. Nonresistance heating elements such as sonic, piezo and jet spray may also be used in the atomizer in place of the heating coil.

The central passage 32 is surrounded by a cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating coil 28.

The liquid reservoir 34 may alternatively include wadding soaked in liquid which encircles the central passage 32 with the ends of the wick 30 abutting the wadding. In other embodiments, the liquid reservoir 34 may comprise a toroidal cavity arranged to be filled with liquid and with the ends of the wick 30 extending into the toroidal cavity.

An air inhalation port 36 is provided at the back end of the atomizer/liquid reservoir portion 14 remote from the end cap 16. The inhalation port 36 may be formed from the cylindrical hollow tube atomizer/liquid reservoir portion 14 or may be formed in an end cap.

In use, a user sucks on the e-cigarette 10. This causes air to be drawn into the e-cigarette 10 via one or more air inlets, such as air inlets 38, and to be drawn through the central passage 32 towards the air inhalation port 36. The change in air pressure which arises is detected by the airflow sensor 24, which generates an electrical signal that is passed to the control electronics 22. In response to the signal, the control electronics 22 activate the heating coil 28, which causes liquid present in the wick 30 to be vaporized creating an aerosol (which may comprise gaseous and liquid components) within the central passage 32. As the user continues to suck on the e-cigarette 10, this aerosol is drawn through the central passage 32 and inhaled by the user. At the same time the control electronics 22 also activate the LED 20 causing the LED 20 to light up which is visible via the translucent end cap 16 mimicking the appearance of a glowing ember at the end of a conventional cigarette. As liquid present in the wick 30 is converted into an aerosol, more liquid is drawn into the wick 30 from the liquid reservoir 34 by capillary action and thus is available to be converted into an aerosol through subsequent activation of the heating coil 28.

Some e-cigarettes are intended to be disposable and the electric power in the battery 18 is intended to be sufficient to vaporize the liquid contained within the liquid reservoir 34, after which the e-cigarette 10 is thrown away. In this embodiment, the battery 18 is rechargeable and the liquid reservoir 34 is refillable. In the cases where the liquid reservoir 34 is a toroidal cavity, this may be achieved by refilling the liquid reservoir 34 via a refill port. In other embodiments, the atomizer/liquid reservoir portion 14 of the e-cigarette 10 is detachable from the power supply portion 12 and a new atomizer/liquid reservoir portion 14 can be fitted with a new liquid reservoir 34 thereby replenishing the supply of liquid. In some cases, replacing the liquid reservoir 34 may involve replacement of the heating coil 28 and the wick 30 along with the replacement of the liquid reservoir 34. A replaceable unit comprising the atomizer 26 and the liquid reservoir 34 is called a cartomizer. In this example, the liquid reservoir 34 comprises an outer refill interface 33, comprising two separate openings 33-1, 33-2, adapted for the reception of two needle elements (not shown) of a connection interface (not shown) of a case which will be described further hereinafter. In FIG. 1, only the first of the separate openings 33-1 is visible. The second separate opening 33-2 which is arranged next to the first separate opening 33-1 is not visible in FIG. 1. In other examples, the liquid reservoir of the electronic smoking device may comprise an outer refill interface comprising only one opening that is adapted for the reception of a single needle element of a connection interface of a case. In this embodiment, the outer refill interface 33 is arranged such that a line La through the two separate openings 33-1, 33-2 is perpendicular to a longitudinal center line CL of the electronic smoking device 10. However, the interface can also be arranged such that a line through the two separate openings is parallel to a longitudinal center line CL of the electronic smoking device 10 or such that it has another orientation which is different from the one shown in FIG. 1.

The new liquid reservoir 34 may be in the form of a cartridge having a central passage 32 through which a user inhales aerosol. In other embodiments, aerosol may flow around the exterior of the cartridge to an air inhalation port 36.

Of course, in addition to the above description of the structure and function of a typical e-cigarette 10, variations also exist. For example, the LED 20 may be omitted. The airflow sensor 24 may be placed adjacent to the end cap 16 rather than in the middle of the e-cigarette. The airflow sensor 24 may be replaced with a switch which enables a user to activate the e-cigarette manually rather than in response to the detection of a change in air flow or air pressure.

Different types of atomizers may be used. For example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively, the atomizer may use a piezoelectric atomizer to create an aerosol either in combination or in the absence of a heater.

Figure 2:
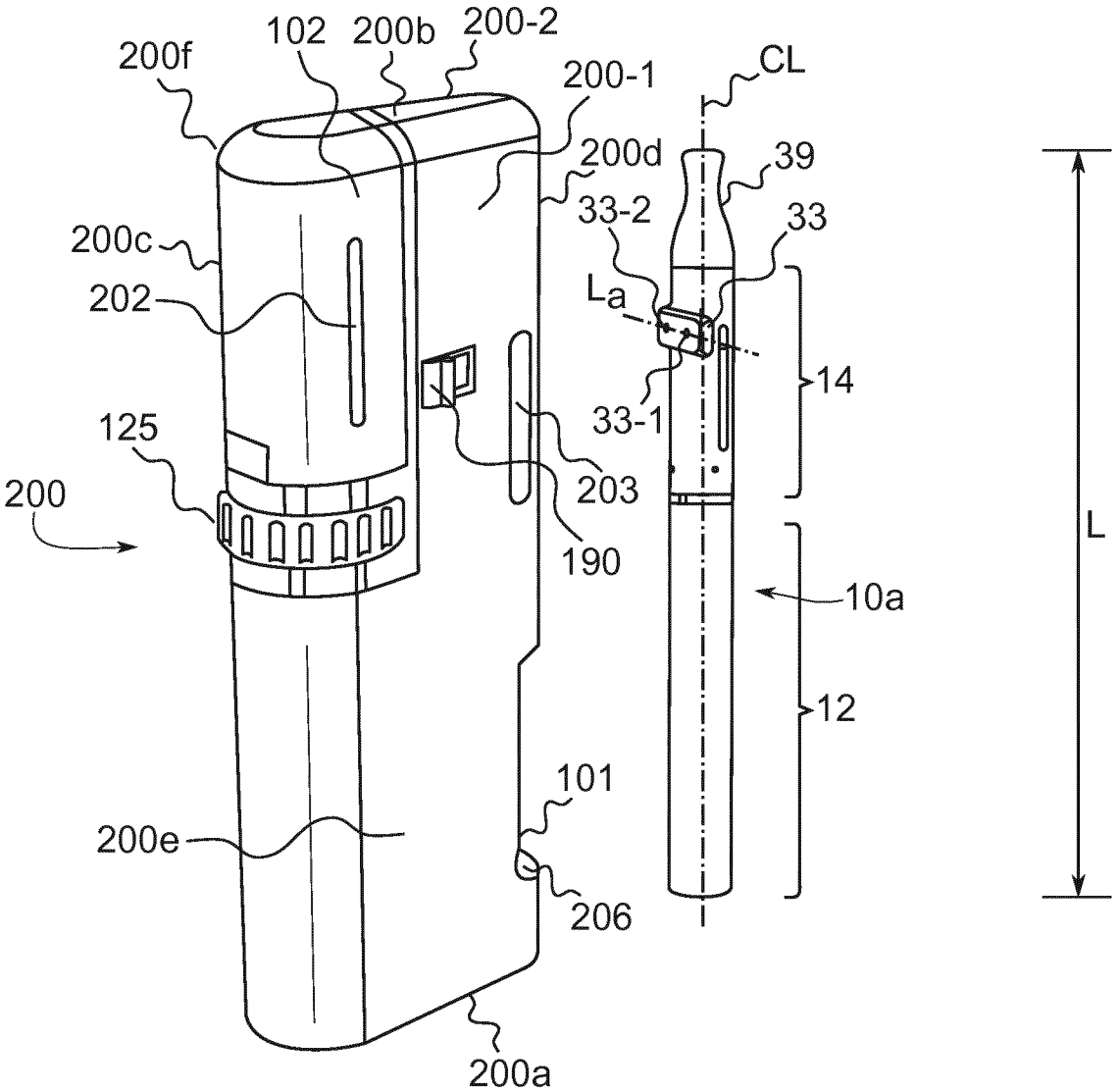
FIG. 2 is a perspective view of a first embodiment of a case for an electronic smoking device with a corresponding electronic smoking device.

The following description related to the FIGS. 2 to 12 is directed to a first embodiment of a case 200 for an electronic smoking device. FIG. 2 shows a perspective view of a first embodiment of a case 200 for an electronic smoking device 10*a* with a corresponding electronic smoking device 10*a* next to the case 200. The electronic smoking device 10*a* is not part of the case 200 but can be received by the case 200.

In this first embodiment, the case 200 substantially has two parts 200-1, 200-2 that together form the case 200. The two parts 200-1, 200-2 have the shape of half-shells with a U-shaped cross-section respectively. The half-shells fit together and in this embodiment are connected and fixed to each other via glue. However, also other forms of connections can be realized, connecting and fixing the two parts 200-1, 200-2 of the case 200 to each other. For example, the parts 200-1, 200-2 can be connected to each other via a push-fit connection, provided for example by engagement elements as retaining lugs, arranged on one of the parts 200-1, 200-2 and corresponding fixation holes or edges arranged on the other one of the parts 200-1, 200-2. Furthermore, it is possible to realize other cases which are integrally formed or which comprise or are made of more than two parts.

The case 200 substantially has a rectangular shape with six sidewalls 200*a*, 200*b*, 200*c*, 200*d*, 200*e*, 200*f*, forming a substantially prismatic body, wherein two side walls 200*a*, 200*b*, 200*c*, 200*d*, 200*e*, 200*f* are arranged on opposing sides of the case 200 respectively, so that three side walls 200*a*, 200*b*, 200*c*, 200*d*, 200*e*, 200*f* have an opposing side wall 200*a*, 200*b*, 200*c*, 200*d*, 200*e*, 200*f* respectively. The smallest side walls 200*a*, 200*b*, 200*c*, 200*d*, 200*e*, 200*f* of the case 200 are the upper and lower side wall 200*a*, 200*b* of the case 200 which represent the upper and lower end of the case 200 and are arranged on opposing sides of the same. In this first embodiment, the case 200 is suited to stand on the lower side wall 200*a* of the case 200. The upper and lower side wall 200*a*, 200*b* both have a narrowing shape and rounded edges. The circumference of the upper and lower side wall 200*a*, 200*b* substantially resembles the circumference of a fan belt strapped around a larger and a smaller wheel respectively. Expressed in other words, the circumference of the upper and lower side wall 200*a*, 200*b* resembles the outline of two circles of a different diameter, wherein the periphery of the bigger circle is connected to the periphery of the smaller circle via two tangential lines on opposing sides of the circles respectively, providing the case 200 with a narrow side and a wide side on opposing sides of the case 200 (see FIG. 12).

The side wall 200*c* on the wide side of the case 200 forms a back end of the same and has a semi-circular, C-shaped cross section. Furthermore, the side wall 200*c* on the wide side of the case 200 comprises a cavity for a rotatable pump wheel 125 which is accessible from an outside of the case 200 and which will be described further hereinafter. The side wall 200*d* on the narrow side of the case 200 also has a semi-circular, C-shaped cross section. Furthermore, a manipulation cavity 206 is arranged within the side wall 200*d* on the narrow side of the case 200, allowing for a user to check whether an electronic smoking device is inserted into the case 200 and to manipulate an electronic smoking device inserted into the case 200, for example in order to arrange an electronic smoking device therein appropriately, which will also be described with greater detail hereinafter. The side wall 200*c* on the wide side of the case 200 and the side wall 200*d* on the narrow side of the case 200 are connected to each other via a side wall 200*e* which is arranged on a front side of the case 200 and a side wall 200*f* which is arranged on a back side of the case 200. The side wall 200*e* on the front side of the case 200 has a first slit-shaped window 202 therein, allowing for a user to check whether a liquid cartridge is inserted into the case 200 which will also be described further hereinafter. Furthermore, in this first embodiment, the side wall 200*e* on the front side of the case 200 comprises a first cavity for a lever element 190 and a second slit-shaped window 203, the second slit shaped window 203 having the shape of a slit that is wider than the first slit-shaped window 202. Moreover, also the side wall 200*f* on the back side of the case 200 comprises a first slit-shaped window, a first cavity for a lever element and a second slit-shaped window, which in FIG. 2 are not visible to the viewer.

The case 200 has rounded edges that provide the case 200 with a smooth and handy design. Furthermore, the case 200 comprises a primary receiving portion 101 that is adapted to receive an electronic smoking device 10*a*. The electronic smoking device 10*a* shown next to the case 200 can be inserted into the receiving portion 101 of the case 200, allowing for the electronic smoking device 10*a* to be transported with and to be refilled via the case 200.

The embodiment of an electronic smoking device 10*a* shown in FIG. 2 is substantially identical to the electronic smoking device 10 as shown in FIG. 1. Thus, also in this embodiment, the electronic smoking device 10*a* exemplarily comprises the same atomizer/liquid reservoir portion 14 and the same power supply portion 12 attached thereto. However, the electronic smoking device 10*a* shown in FIG. 2 exemplarily further comprises a nozzle-shaped mouthpiece 39 that is attached to the liquid reservoir 34, comprising an opening that is aligned to the air inhalation port 36 arranged within the liquid reservoir 34.

In this embodiment of the electronic smoking device 10*a*, two refill openings 33-1, 33-2 are arranged within an outer refill interface 33 which protrudes from the liquid reservoir 34 and in this embodiment exemplarily has a trapezoid shape. The refill openings 33-1, 33-2 are arranged within a line La that is perpendicular to the longitudinal center line CL of the electronic smoking device 10*a*. Expressed in other words, the line La in that the refill openings 33-1, 33-2 of the outer refill interface 33 are arranged in, is perpendicular to the length of the electronic smoking device 10*a*. However, also other electronic smoking devices with other liquid reservoirs, with other outer refill interfaces and with other refill openings within such other outer refill interfaces can be realized, that are receivable by other embodiments of cases. Furthermore, also other embodiments of cases can be realized, comprising other shapes or components with another arrangement and/or dimension. For example, a case can be provided without the aforementioned window elements, without or with other actuation elements arranged on other positions of the case.

Figure 3:
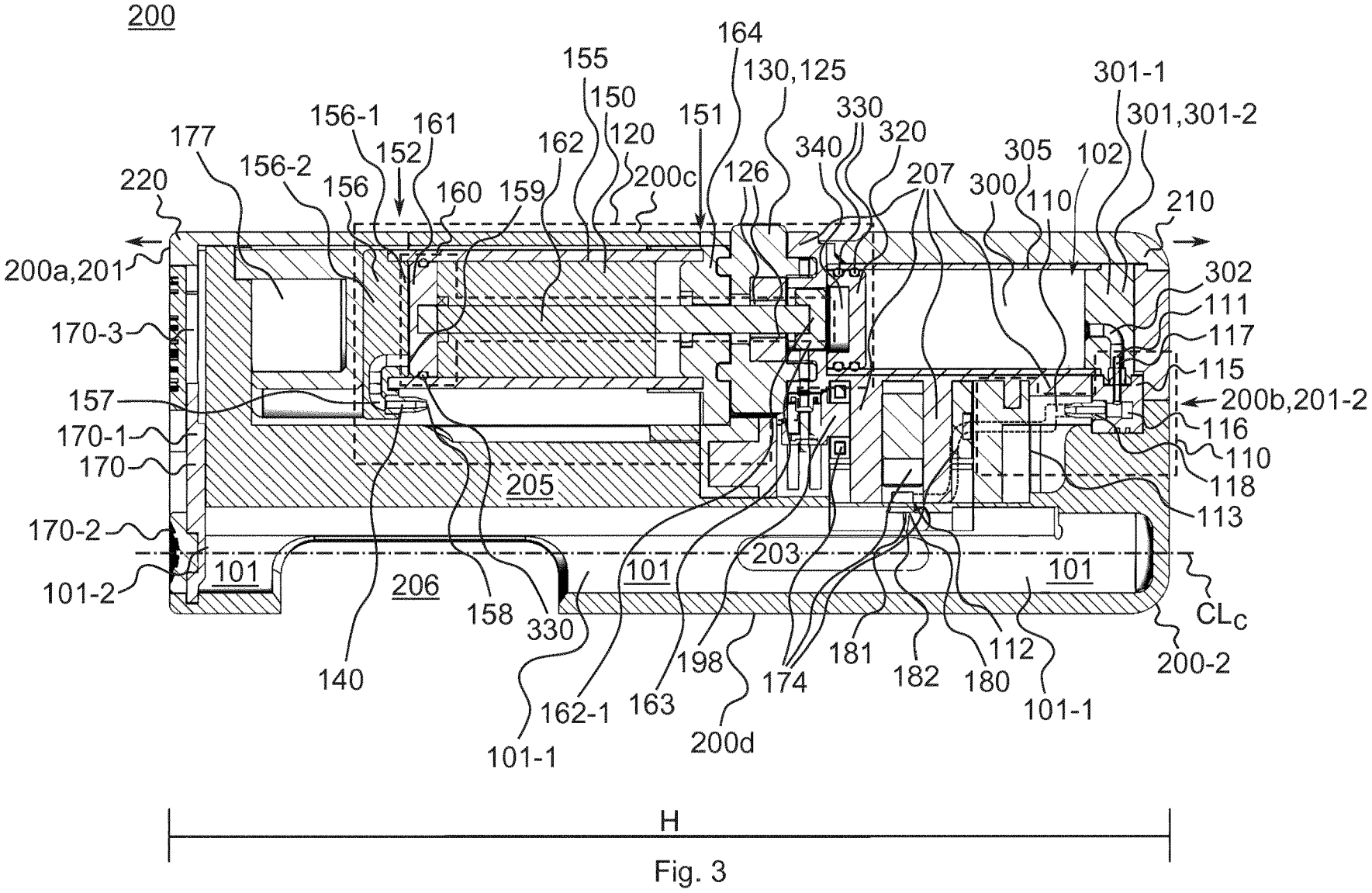
FIG. 3 is a schematic cross-sectional illustration of the first embodiment of the case for an electronic smoking device in a disassembled state.

In FIG. 3, it is shown a schematic cross-sectional illustration of the first embodiment of the case 200 for an electronic smoking device in a disassembled state. In FIG. 3, the case 200 is shown without the first part 200-1 of the case 200, only showing the lower half-shell of the same with the components of the case 200 arranged therein. The case 200 comprises a primary receiving portion 101 that is adapted to receive an electronic smoking device 10, 10*a* and a secondary receiving portion 102, adapted to receive a liquid cartridge 300, adapted to contain a liquid. Furthermore, the case 200 comprises a liquid channel system 110 for the transport of liquid within the case 200, wherein the liquid channel system 110 comprises a liquid inlet 111, adapted to be connected to a liquid cartridge 300 received by the secondary receiving portion 102, a liquid outlet 112, and a liquid channel component 113, interconnecting the liquid inlet 111 and the liquid outlet 112. The case 200 further comprises a pump system 120 with an actuation element 130, adapted to provide liquid from a liquid cartridge 300 received by the secondary receiving portion 102 to the liquid outlet 112 via the liquid channel system 110 upon an actuation of the actuation element 130. An advantage of such a case 200 may be that it allows for a safe and handy transport of an electronic smoking device 10, 10*a* while simultaneously enabling a refill of the liquid reservoir of the electronic smoking device 10, 10*a* received by the case 200 via the pump system 120. In this first embodiment, the primary receiving portion 101 is arranged adjacent to the side wall 200*d* on the narrow side of the case 200. The primary receiving portion 101 comprises an elongated cavity 101-1, adapted to enclose an electronic smoking device 10, 10*a* along its entire length L, the cavity 101-1 comprising a primary opening 101-2 on a first side 201 of the case 200, wherein the primary opening 101-2 is closeable via a slidable locking element 170 arranged on or adjacent to the first side 201 of the case 200. An advantage of such a case 200 may be that an electronic smoking device 10, 10*a* can be safely stored within the case 200. Furthermore, the slidable locking element 170 allows to insert and to remove an electronic smoking device 10, 10*a* that is received by the primary receiving portion 101. Expressed in other words, an electronic smoking device 10, 10*a* can be fully inserted into and removed from the elongated cavity 101-1 of the primary receiving portion 101 via the primary opening 101-2 arranged within a tip portion at the lower sidewall 200*a* at the first side 201 of the case 200. The elongated cavity 101-1 substantially has the shape of a tube that has a central axis CLc which is parallel to the height H of the case 200. The elongated cavity 101-1 is formed by the portions of the side walls 200*a*, 200*b*, 200*c*, 200*d*, 200*e*, 200*f* of the case 200 which together form the narrow side of the same and by an internal retaining wall 205 formed within the case 200. The elongated cavity 101-1 extends from the first side 201 of the case 200 to an opposing second side 201-2 of the case 200.

In an area of the side walls 200*d*, 200*e*, 200*f* of the narrow, front and back side of the case 200, in that these side walls 200*d*, 200*e*, 200*f* enclose an electronic smoking device 10, 10*a* inserted into the elongated cavity 101-1 and delimitate the elongated cavity 101-1, the side walls 200*d*, 200*e*, 200*f* comprise a manipulation cavity 206 that has the shape of a cut-out, allowing for a user of the case 200 to manipulate the position of an electronic smoking device 10, 10*a* received by the primary receiving portion 101 of the cavity 200. Furthermore, in the area of the elongated cavity 101-1, the side walls 200*e*, 200*f* of the front and back side of the case 200 each comprise a second slit-shaped window 203 respectively, allowing for an insight into the case 200 and onto an electronic smoking device 10, 10*a* inserted into the case 200.

The slidable locking element 170 is arranged on the lower side wall 200*a* at the first side of the case 200, the slidable locking element 170 being moveable between an opened and a closed position. The slidable locking element 170 comprises a slide plate 170-1 and a knob 170-2 attached to the slide plate 170-1. The lower side wall 200*a* at the first side of the case 200 comprises a slide cavity 170-3 which has an opening that faces the primary opening 101-2 of the elongated cavity 101-1 and that is adapted to receive the slide plate 170-1. The slide plate 170-1 is configured slidable within the slide cavity 170-3 along a direction which is perpendicular to the height H of the case 200. Thus, a first end of the slide plate 170-1 is always inserted into the slide cavity 170-3, notwithstanding the position of the slidable locking element 170. The knob 170-2 has a concave, corrugated surface and is attached to the slide plate 170-1 at a second end of the slide plate 170-1. The second end is on a side of the slide plate 170-1 which is opposing the side the first end of the slide plate 170-1 is positioned at. In the opened position of the case 200, the slide plate 170-1 is inserted into the slide cavity 170-3 to a maximum extent with only the part of the slide plate 170-1 comprising the knob 170-2 protruding from the slide cavity 170-3. In the closed position, the slide plate 170-1 is released from the slide cavity 170-3 to a maximum extent, entirely covering the primary opening 101-2 of the elongated cavity 101-1 of the case 200. The inner side of the side wall 200*d* on the narrow side of the case 200 comprises a reception cavity corresponding to an edge of the slide plate 170-1, allowing for the edge of the slide plate 170-1 to engage with the corresponding reception cavity when the slide plate 170-1 is released from the slide cavity 170-3 to a maximum extent, the case 200 being in the closed position.

The movement of the slidable locking element 170 can for example be achieved by placing a finger, for example a thumb, onto the knob 170-2, while holding the case 200 in the same or in the other hand, pushing the slide plate 170-1 into the slide cavity 170-3 or out of the slide cavity 170-3, thereby opening or closing the primary opening 101-2 of the elongated cavity 101-1 of the case 200.

Figure 4:
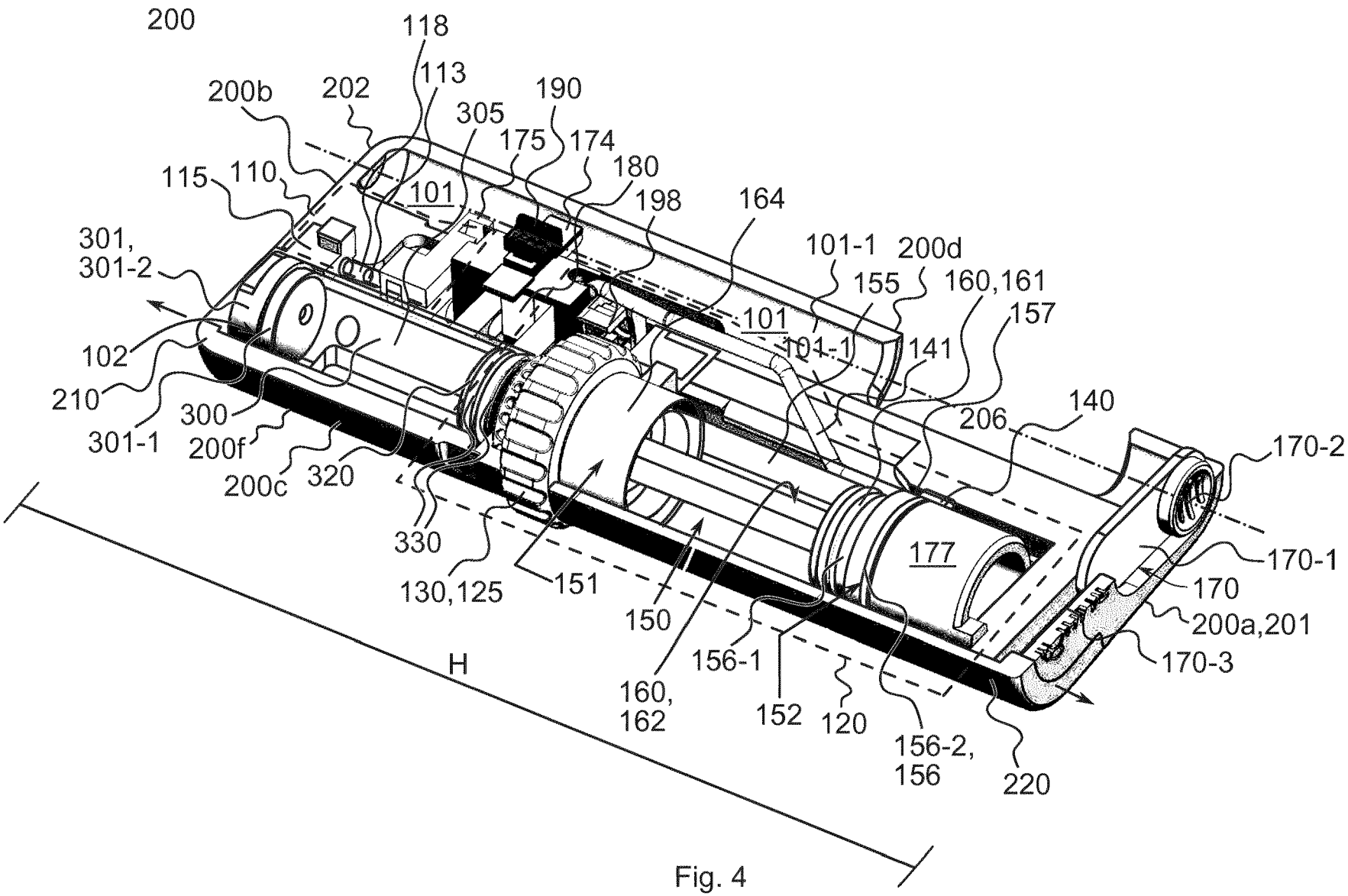
FIG. 4 is a schematic perspective illustration of the first embodiment of the case for an electronic smoking device in a disassembled state.

In FIG. 4, the first embodiment of the case 200 for an electronic smoking device 10*a* is shown in a schematic perspective illustration, in a disassembled state. Also in FIG. 4—just as in FIG. 3—the case 200 is shown without the first part 200-1 of the case 200, only showing the lower half-shell of the same with the components of the case 200 arranged therein.

In FIGS. 3 and 4, the secondary receiving portion 102 is shown with a liquid cartridge 300 arranged therein. Expressed in other words, in the FIGS. 3 and 4, the secondary receiving portion 102 received a liquid cartridge 300. The secondary receiving portion 102 is arranged at an upper corner of the case 200, underneath the upper sidewall 200*b* of the same and adjacent to the side walls 200*c*, 200*e*, 200*f* of the wide side and the front and back side of the case 200. The aforementioned side walls 200*b*, 200*c*, 200*e*, 200*f* and a retaining frame component 207 arranged within the case 200, together enclose/delimit a substantially tube-shaped volume which in this embodiment is adapted to receive the liquid cartridge 300 of a predefined size. Moreover, in this first embodiment, the portions of the side walls 200*b*, 200*c*, 200*e* and 200*f* of the case 200, that form the upper corner of the case 200, enclosing the secondary receiving portion 102, together form an integral upper corner part 210 of the case 200 that is configured detachable from the case 200. In this first embodiment, the upper corner part 210 of the case can be slid off the case 200 in an upwards direction which in FIGS. 3 and 4 is indicated by an arrow. This allows for an eased replacement of the liquid cartridge 300 when the same is emptied.

Figure 5A:
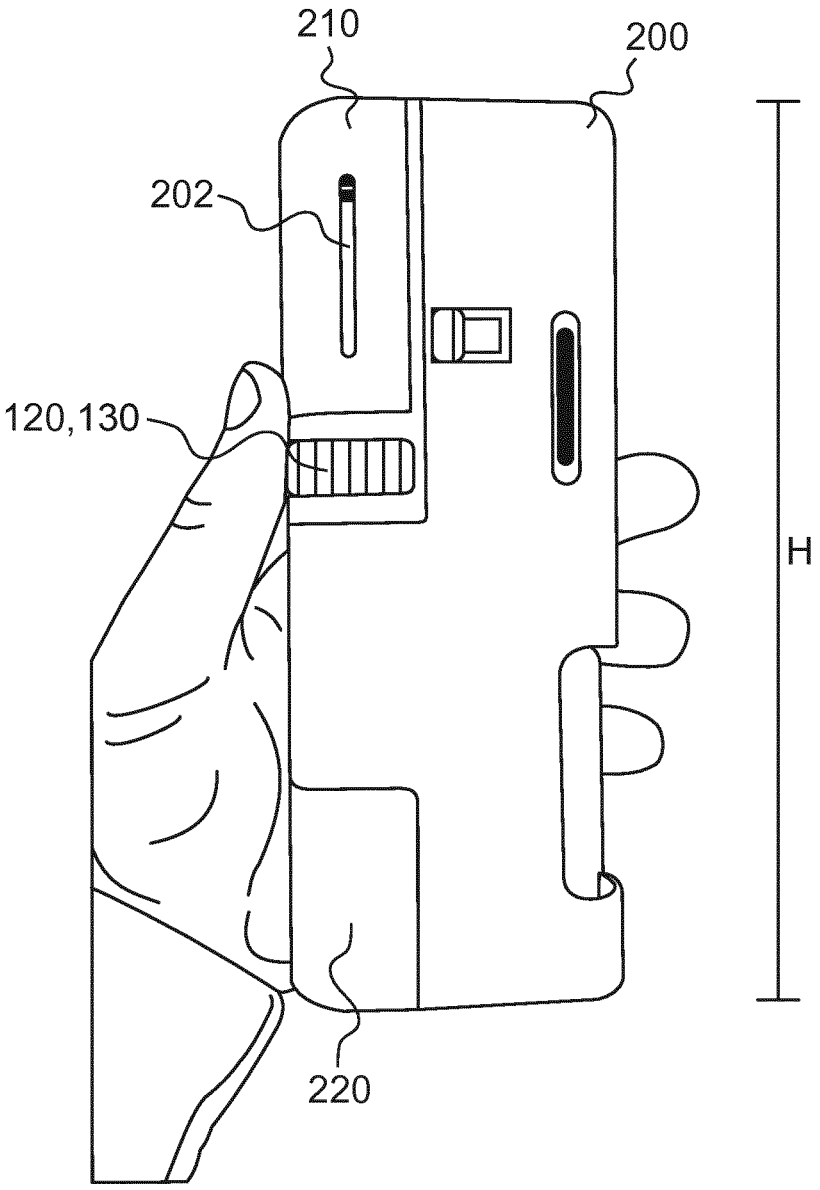
FIGS. 5*a* to 5*e* show different states of the first embodiment of the case during a replacement procedure of the liquid cartridge of the first embodiment of the case.
Figure 5B:
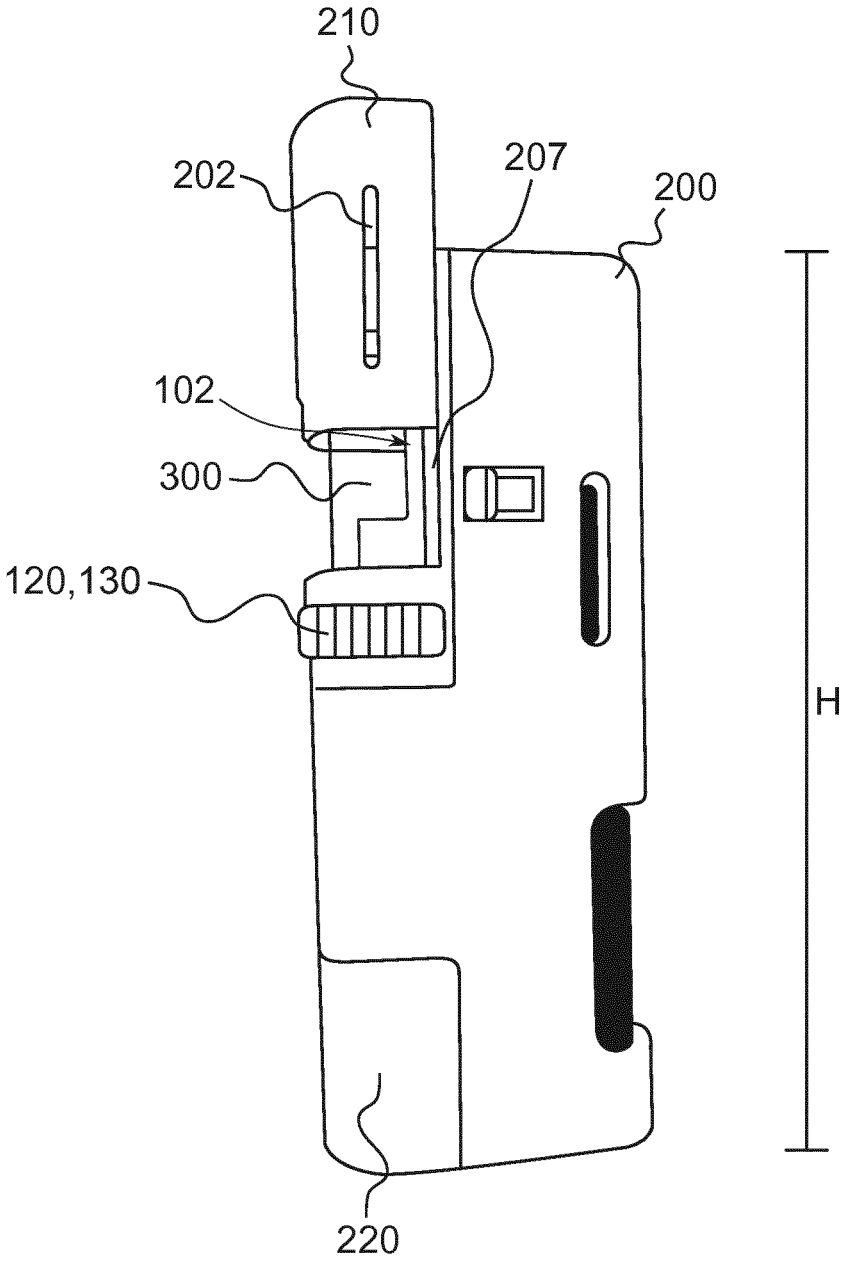
Figure 5C:
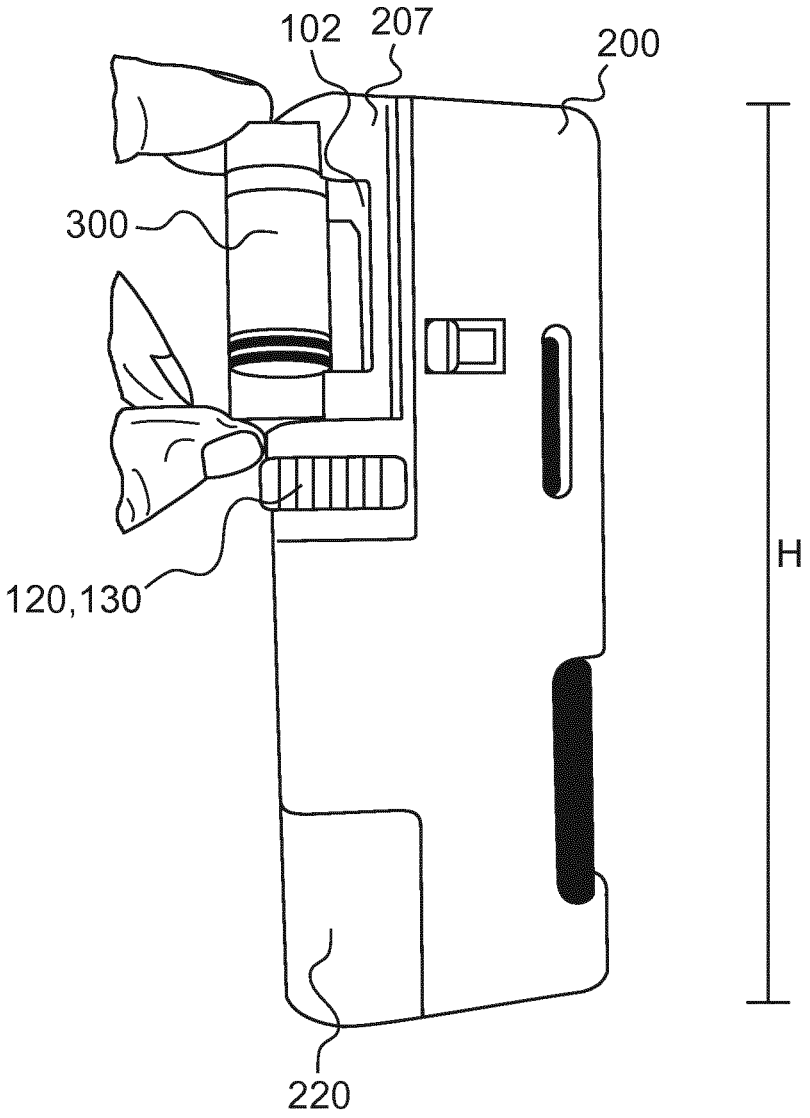
Figure 5D:
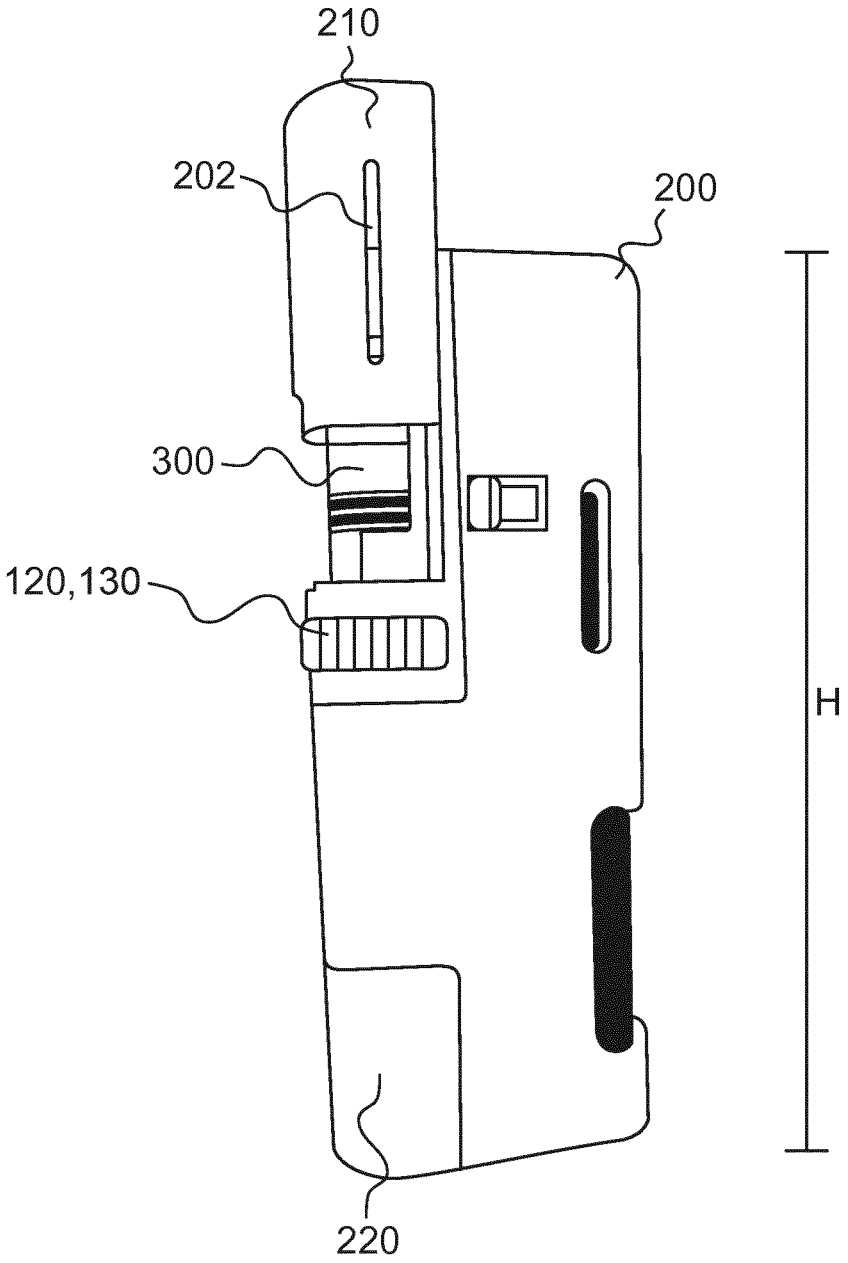
Figure 5E:
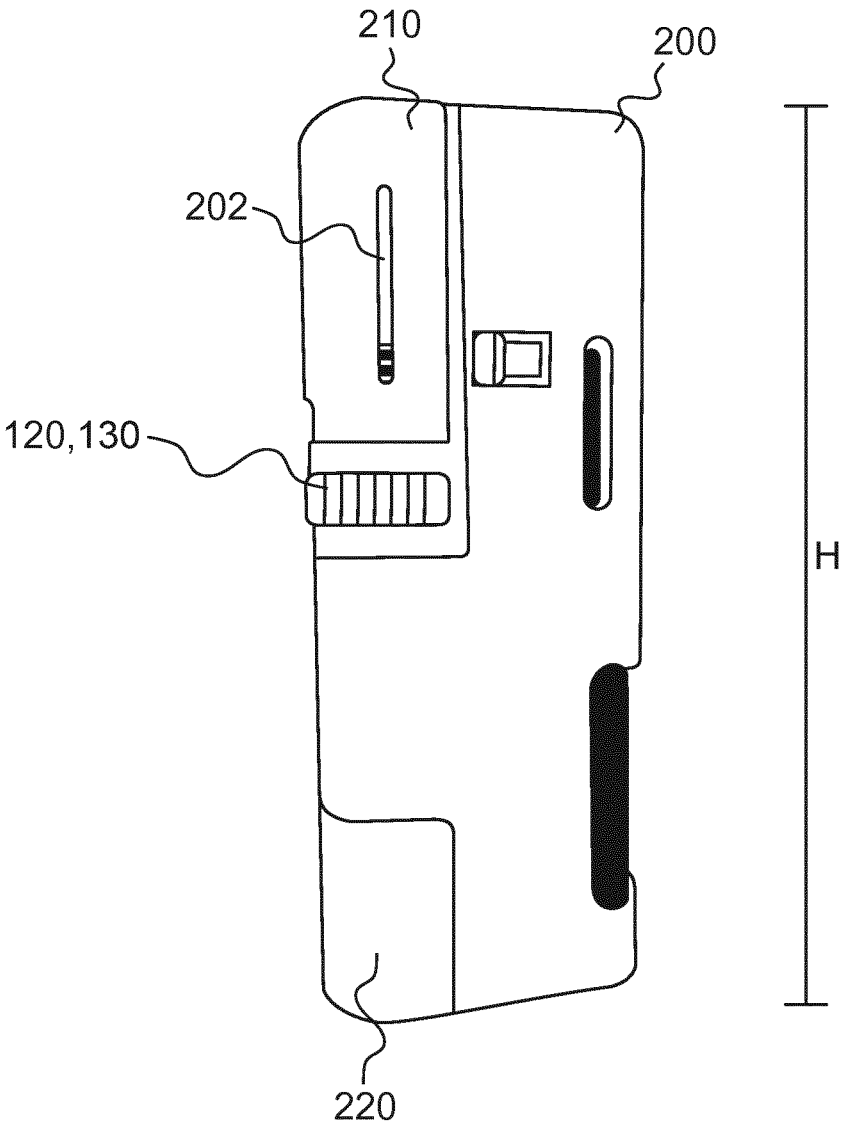

For the sake of a better understanding, the replacement procedure of the liquid cartridge 300 is shown in the FIGS. 5*a* to 5*e*. FIGS. 5*a* to 5*e* show the first embodiment of the case 200 as shown in the FIGS. 2 to 4 in a fully assembled state. In FIG. 5*a*, the case 200 is held in the left hand of a user who has the thumb at the left hand positioned on the upper corner part 210 of the case 200. Via the first slit-shaped window 202 arranged within the upper corner part 210, it can be seen that the liquid cartridge 300 arranged within the secondary reception portion 102 is emptied and needs to be replaced. Therefore, the user can pull or push up the upper corner part 210 of the case 200 along a direction which is parallel to the height H of the case 200 and pointing away from the first side 201 of the case 200, sliding it along a sliding cavity arranged within the retaining frame component 207 of the case 200. This pulling or pushing of the upper corner part 210 can be performed using for example the thumb of the left hand or via a pinch-movement performed with two fingers using the right hand. In FIG. 5*b*, the upper corner part 210 is shown in a semi-removed state with the liquid cartridge 300 arranged below. Furthermore, the retaining frame component 207 with the sliding cavity therein can be seen, allowing for the upper corner part 210 to be moved in an upwards direction. In order to replace the liquid cartridge 300 arranged within the secondary receiving portion 102, the upper corner part 210 needs to be fully removed. This is shown in FIG. 5*c* where a new liquid cartridge 300 that is inserted into the secondary receiving portion 102. The upper corner part 210 is fully removed so that the new liquid cartridge 300 can easily be inserted into the retaining frame component 207. The new liquid cartridge 300 is inserted from a side of the case 200. However, in order to do so, the aforementioned pump mechanism 120—of which in the FIGS. 5*a* to 5*e* only the actuation element 130 is shown—must be brought to a refill state, which will be described further hereinafter. After the liquid cartridge 300 is fully inserted and fitted into the secondary receiving portion 102, the upper corner part 210 can be slid back onto the case 200. This is shown in the FIGS. 5*d* and 5*e*, where the upper corner part 210 is reattached to the case 200, sliding with a sliding corner arranged on the upper corner part 210 within the sliding cavity that is arranged within the retaining frame component 207.

Figure 6A:
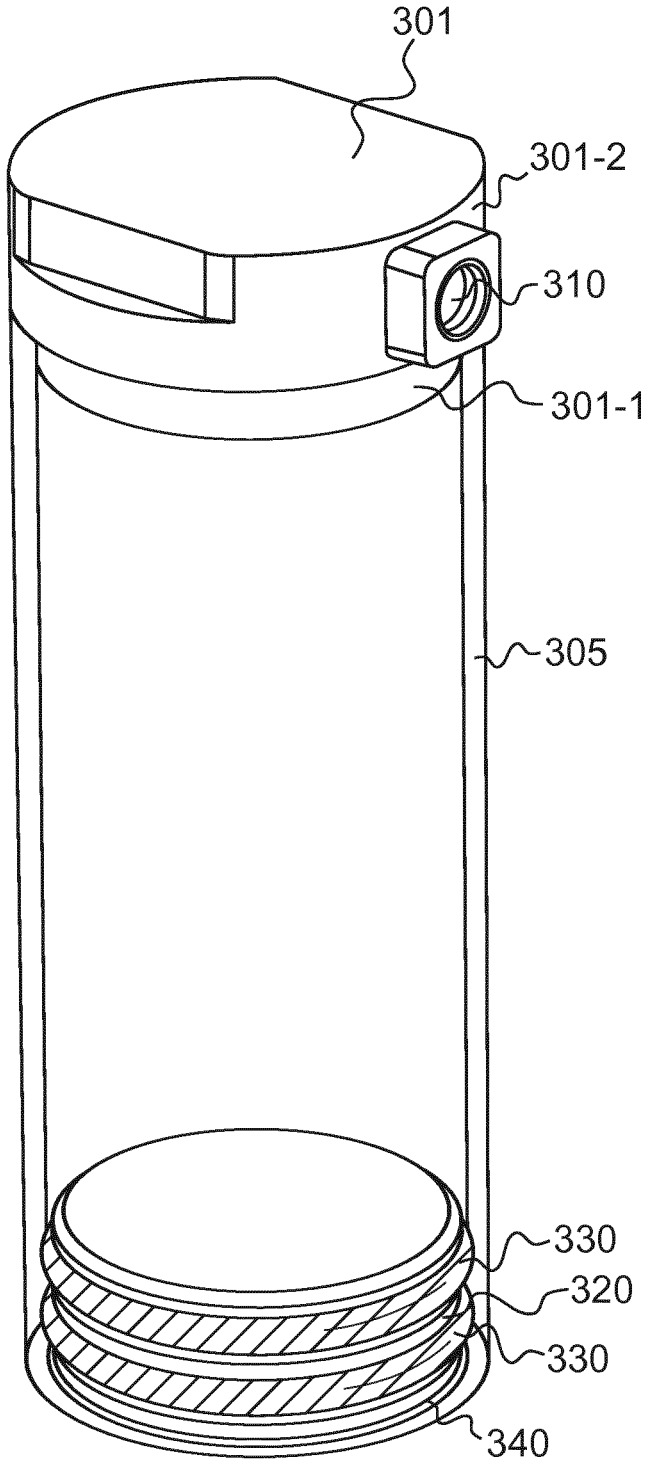
FIG. 6*a* is a schematic perspective illustration of a liquid cartridge of the first embodiment of the case.

The liquid cartridge 300 is adapted to be received by the first embodiment of the case 200. Detailed views of the liquid cartridge 300 are shown in the FIGS. 6*a* to 6*d*. In FIG. 6*a*, a schematic perspective view of the liquid cartridge 300 is shown wherein in FIG. 6*b*, a cross section of the liquid cartridge 300 is illustrated. The liquid cartridge 300 is substantially tube-shaped, having the shape of a hollow cylinder, comprising a circular outer wall 305 that encloses a predefined volume for the reception of a smokeable liquid. Expressed in other words, the liquid cartridge 300 has a tube-shaped circular outer wall 305 forming a base part of the liquid cartridge 300. In this first embodiment, the tube-shaped circular outer wall 305 exemplarily comprises a transparent plastic, allowing for a user to see the filling level of the liquid cartridge 300.

The liquid cartridge 300 comprises a cartridge cap 301 that is fitted into an upper portion of the tube-shaped circular outer wall 305, forming a top part of the liquid cartridge 300. The cartridge cap 301 has a substantially cylindrical shape, comprising two substantially cylindrical portions of a different diameter. In more detail, the cartridge cap 301 is integrally formed, comprising a first and a second cylindrical portion 301-1, 301-2 substantially having the shape of cylinders with different diameters respectively. The first cylinder/cylindrical portion 301-1 of the cartridge cap 301 has a diameter which is smaller than the diameter of the second cylinder/cylindrical portion 301-2 of the cartridge cap 301. The first cylinder/cylindrical portion 301-1 represents a fitting for the tube-shaped circular outer wall 305. Thus, it can be fitted into and fixed within an upper rim portion of the tube-shaped circular outer wall 305 of the liquid cartridge 300. In this first embodiment, the cartridge cap 301 is exemplarily glued to the upper rim portion of the tube-shaped circular outer wall 305. However, also other embodiments of cases can be realized with other liquid cartridges, for example with liquid cartridges that have liquid cartridge caps that are integrally formed with the outer walls of the same. When the first cylinder/cylindrical portion 301-1 is fitted into and fixed within the upper rim portion of the tube-shaped circular outer wall 305 of the liquid cartridge 300, the second cylinder/cylindrical portion 301-2 rests on the outer circumference of the upper rim portion of the tube-shaped circular outer wall 305 of the liquid cartridge 300.

In this first embodiment, the cartridge cap 301 comprises a cartridge cap channel 302 which extends through the first and the second cylinder/cylindrical portions 301-1, 301-2 of the cartridge cap 301, allowing for liquid to flow from inside of the liquid cartridge 300 to an outside of the same. Expressed in other words, the cartridge cap channel 302 connects a cartridge outlet 310 of the cartridge cap 301, arranged on an outer side of the same, with a cartridge cap inlet 303, arranged inside the liquid cartridge 300 when the same is closed and sealed with the cartridge cap 301. The cartridge outlet 310 of the cartridge cap 301 is arranged on the outer periphery of the second cylinder/cylindrical portion 301-2 of the cartridge cap 301 and comprises a rectangular protrusion. The opening of the cartridge outlet 310 is arranged in the center of the rectangular protrusion. FIG. 6*c* shows a magnified detailed view of the cartridge cap 301 with the cartridge cap channel 302, the cartridge outlet 310 and the cartridge cap inlet 303.

Figure 6B:
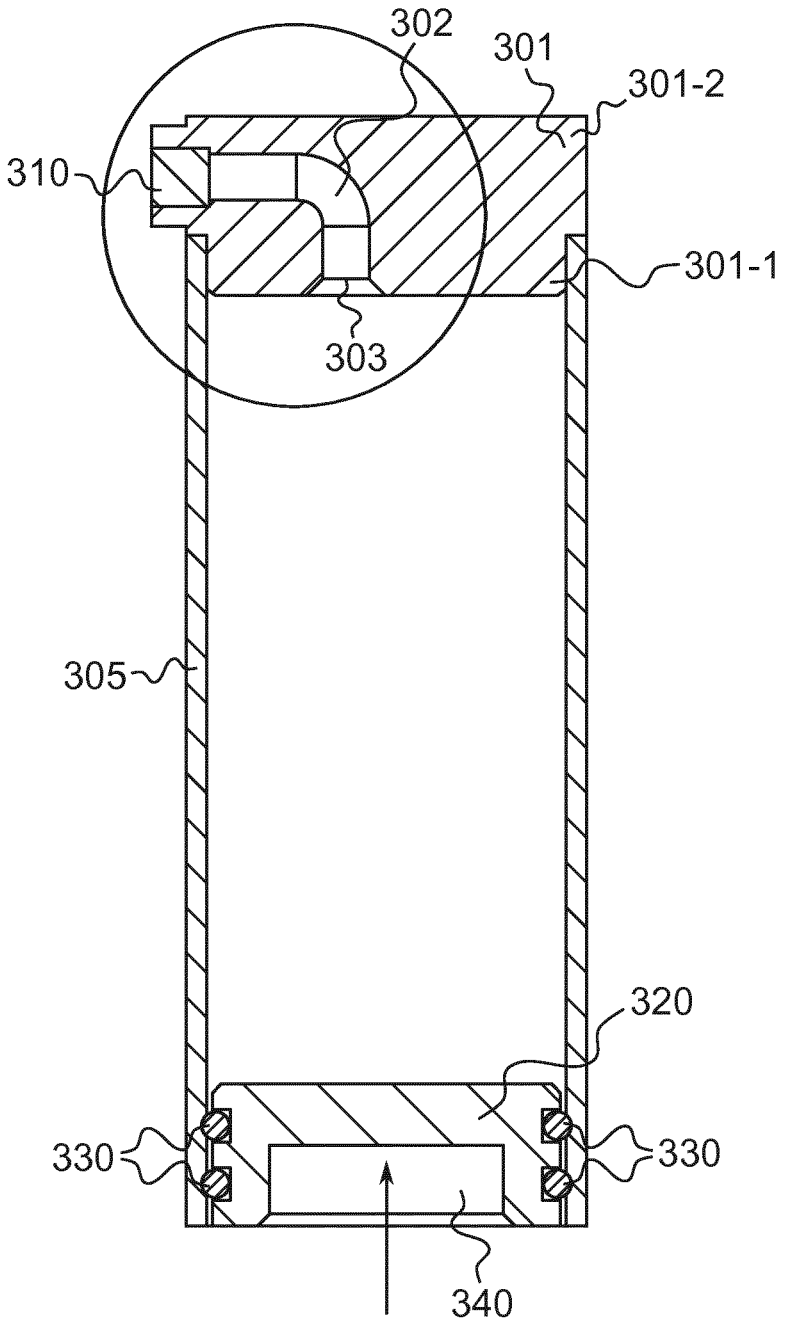
FIG. 6*b* is a schematic cross-sectional illustration of the liquid cartridge of the first embodiment of the case.
Figure 6C:
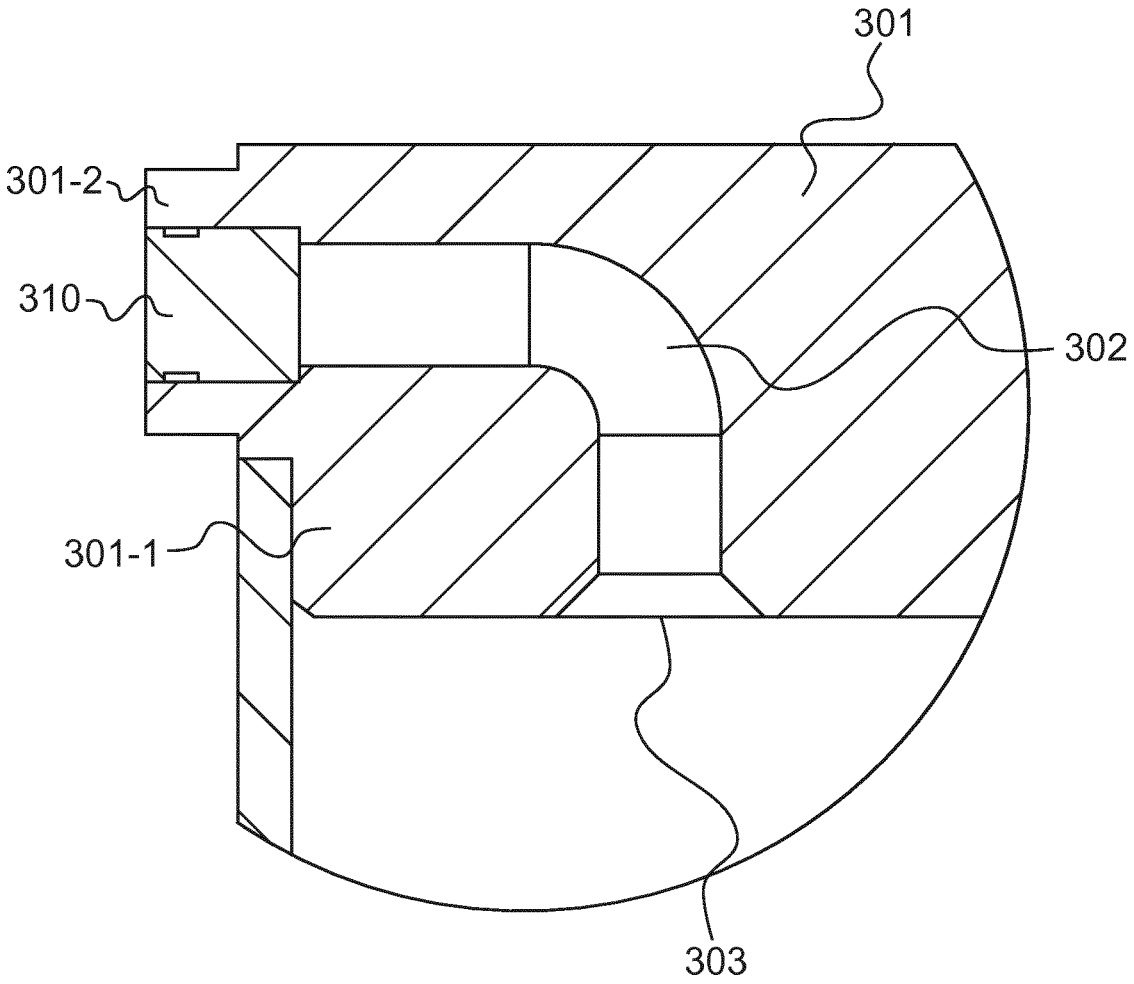
FIG. 6*c* is a zoom into a section of the schematic cross-sectional illustration of the liquid cartridge of the first embodiment of the case.

The liquid cartridge 300 further comprises an integrated slider portion 320 which in FIG. 6*a* and FIG. 6*b* is positioned at a bottom portion of the tube-shaped circular outer wall 305 of the liquid cartridge 300. The integrated slider portion 320 is configured slidable along the inner side of the tube-shaped circular outer wall 305 of the liquid cartridge 300. In this first embodiment, the integrated slider portion has the shape of a circular plunger or of a circular piston which is in contact with the inner side of the tube-shaped circular outer wall 305 and can be moved, in more detail slid along the inner side of this wall 305 of the liquid cartridge 300. The integrated slider portion 320 in this first embodiment exemplarily comprises two ring-shaped gasket elements that provide for the contact between the integrated slider portion 320 and the inner side of the tube-shaped circular wall 305 of the liquid cartridge 300. The two ring-shaped gasket elements 330 are both exemplarily realized as an O-ring respectively and are both arranged within a respective circumferential cavity, provided within the outer circumference of the integrated slider portion 320 of the liquid cartridge 300 respectively. The outer circumference of the integrated slider portion 320 of the liquid cartridge 300 faces the inner side of the tube-shaped circular outer wall 305 of the liquid cartridge 300. Moreover, the integrated slider portion 320 comprises a reception cavity 340 arranged within a rear side of the integrated slider portion 320. This reception cavity 340 allows for the integrated slider portion 320 to be connected to a plunger component (not shown) in order to be moved within the liquid cartridge 300, increasing and decreasing the space between the integrated slider portion 320 and the cartridge cap 301, depending on the direction of the movement. Thus, via the integrated slider portion 320, liquid contained within the liquid cartridge 300 can be pushed out of the liquid cartridge 300 via the cartridge cap inlet 303, the cartridge cap channel 302 and the cartridge outlet 310 when the space between the integrated slider portion 320 and the cartridge cap 301 is decreased. Expressed in other words, liquid is pushed out of the cartridge outlet 310 when the integrated slider portion 320 is moved towards the cartridge cap 301.

The liquid cartridge 300 is adapted to receive any kind of liquid that is suited for the liquid reservoir 34 of an electronic smoking device 10, 10*a*. Such a liquid for example can comprise nicotine. In addition, flavored components can be added to the liquid, for example esters, such as isoamyl acetate, linalyl acetate, isoamyl propionate, linalyl butyrate and the like or natural essential oils as plant essential oils, such as spearmint, peppermint, *cassia*, jasmine and the like or animal essential oils, such as musk, amber, civet, castor and the like or simple flavoring materials, such as anethole, limonene, linalool, eugenol and the like or hydrophilic flavor components such as a leaf tobacco extract or natural plant flavoring materials such as licorice, St. John's wort, a plum extract, a peach extract and the like or acids such as a malic acid, tartaric acid, citric acid and the like or sugars such as glucose, fructose, isomerized sugar and the like or polyhydric alcohols such as propylene glycol, glycerol, sorbitol and the like. It is also possible to combine different flavored components as mentioned above into new flavored liquids. However, the liquid cartridge 300 further can be adapted to receive any other kind of liquid.

Figure 6D:
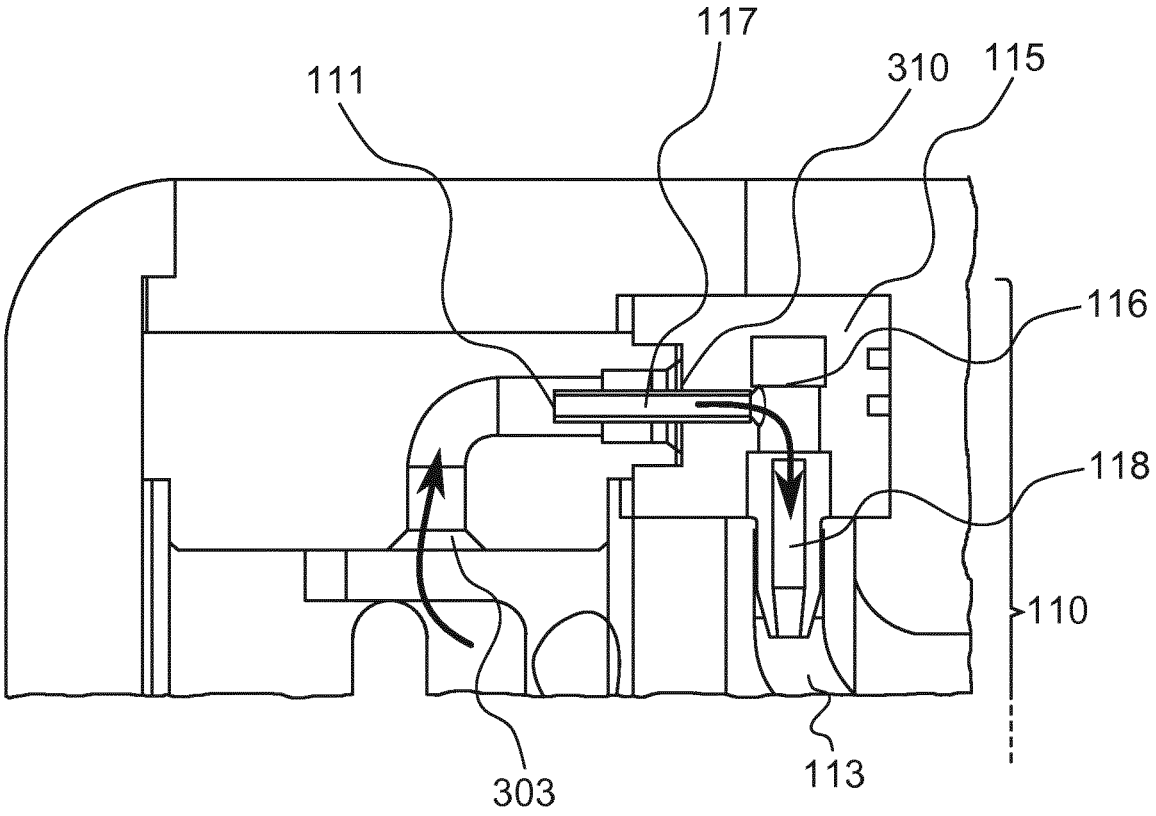
FIG. 6*d* is a schematic cross-sectional illustration of the liquid cartridge of the first embodiment of the case in a state in which it is connected to a cartridge interface element of the case.

In the FIGS. 3, 4 and 6*d*, it is shown how the cartridge outlet 310 of the liquid cartridge 300 is connected to the liquid inlet 111 of the liquid channel system 110 of the case 200. Expressed in other words, when the liquid cartridge 300 is arranged within the secondary receiving portion 102 of the case 200, the cartridge outlet 310 of the liquid cartridge 300 is connected to the liquid inlet 111 of the case 200, allowing for liquid to flow from the liquid cartridge 300 into the liquid channel system 110 of the case 200. In this first embodiment, the liquid channel system 110 of the case 200 comprises a cartridge interface element 115 that has an interface element channel 116 which is connected to a cartridge needle 117, protruding from the interface element channel 116 of the cartridge interface element 115 into the secondary receiving portion 102. Thus, when the liquid cartridge 300 is inserted into the secondary receiving portion 102 of the case 200, the cartridge needle 117 is directly inserted into the opening of the cartridge outlet 310 of the liquid cartridge 300, bringing the liquid channel system 110 of the case 200 into communication with the inner volume of the liquid cartridge 300. In this first embodiment, the liquid inlet 111 of the liquid channel system 110 is arranged at the tip of the hollow cartridge needle 117. Therefore, in this first embodiment of the case 200, the liquid inlet 111 of the liquid channel system 110 is positioned within the cartridge outlet 310 of the liquid cartridge 300 when the liquid cartridge 300 is received by the secondary receiving portion 102 of the case 200. The cartridge needle 117 is arranged perpendicular to the interface element channel 116, enclosing a right angle with the same. Moreover, the liquid channel system 110 further comprises a nozzle connection piece 118 that provides for a prolongation of the interface element channel 116 and is arranged within a corresponding cavity within the cartridge interface element 115. The nozzle connection piece 118 protrudes out of the cartridge interface element 115 and into a direction that is perpendicular to the direction of extension of the cartridge needle 117. The liquid channel component 113 of the liquid channel system 110 is connected to the nozzle connection piece 118. The liquid channel component 113 interconnects the liquid inlet 111 and the liquid outlet 112 of the liquid channel system 110, allowing for liquid to be transported from the liquid cartridge 300 to a connection interface 180 of the case 200 which is shown in FIGS. 3 and 4. The connection interface 180 of the case 200 is adapted to be connected to an electronic smoking device received by the primary receiving portion 101 which will be described further hereinafter.

As can be seen in the FIGS. 3 and 4, the pump system 120 is arranged adjacent to the secondary receiving portion 102, in a straight line with the same, the straight line being parallel to the height H of the case 200. In this first embodiment, the pump system 120 comprises an air channel system 140 and an air suction reservoir 150 arranged within the case 200, the air suction reservoir 150 being connectable to an electronic smoking device 10, 10*a* received by the primary receiving portion 101 via the air channel system 140. And advantage of that may be that the pump system 120 can easily be used for a refill of the liquid reservoir 34 of an electronic smoking device 10, 10*a* received by the primary receiving portion 101, wherein the air that is ousted out of the liquid reservoir 34 of the electronic smoking device 10, 10*a* is recaptured by the pump system 120, using the air suction reservoir 150. Thus, the refilling procedure enabled by the pump system 120 allows for a refill of the liquid reservoir 34 of an electronic smoking device 10, 10*a* without that liquid is spilled. In this first embodiment, the air suction reservoir 150 is larger than the liquid cartridge 300 that is arranged within the secondary receiving portion 102. Moreover, in this first embodiment, also the air suction reservoir 150 is substantially tube-shaped, having the shape of a hollow cylinder, comprising a circular reservoir wall 155 that encloses a predefined volume for the suction of air from a liquid reservoir 34 of an electronic smoking device 10, 10*a*. Expressed in other words, the air suction reservoir 150 has a tube-shaped circular reservoir wall 155 forming a base part of the air suction reservoir 150. Also the tube-shaped circular reservoir wall 155 exemplarily comprises a transparent plastic. Furthermore, the air suction reservoir 150 comprises a plunger component 160, the plunger component 160 having a plunger 161 that is arranged movably within the air suction reservoir 150 and a threaded rod 162 attached to the plunger 161, wherein the threaded rod 162 is protruding from a front portion 151 of the air suction reservoir 150. The front portion 151 at the air suction reservoir 150 is facing the secondary receiving portion 102. An advantage of that may be that such a plunger component 160 on the one hand allows for an improved suction of air, providing for an air-tight connection between the plunger 161 and the inner sides of the outer reservoir wall 155 of the air suction reservoir 150 which enables the generation of an over- or underpressure within the air suction reservoir 150. On the other hand, such a plunger component 160 simultaneously allows for a movement of the integrated slider portion 320 of the liquid cartridge 300, serving as a pump mechanism for the same, allowing to push liquid out of the liquid cartridge 300 via the cartridge outlet 310. In this first embodiment, also the air suction reservoir 150 comprises a reservoir cap 156 that is substantially identical to the cartridge cap 301. In this first embodiment, the reservoir cap 156 is fitted into a back portion 152 of the tube-shaped reservoir wall 155 of the air suction reservoir 150, forming a back end of the air suction reservoir 150. The reservoir cap 156 substantially has a cylindrical shape, comprising two substantially cylindrical portions 156-1, 156-2 of a different diameter. In more detail, the reservoir cap 156 is integrally formed, comprising a first and a second cylindrical portion 156-1, 156-2 substantially having the shape of cylinders with different diameters respectively. The first cylinder/cylindrical portion 156-1 of the reservoir cap 156 has a diameter that is smaller than the diameter of the second cylinder/cylindrical portion 156-2 of the reservoir cap 156. The first cylinder/cylindrical portion 156-1 represents a fitting for the tube-shaped circular outer reservoir wall 155. Thus, it can be fitted into and fixed within the back portion 152 of the tube-shaped circular reservoir wall 155 of the air suction reservoir 150. In this first embodiment, the reservoir cap 156 is exemplarily glued to the back portion 152 of the tube-shaped circular reservoir wall 155. However, also other embodiments of cases can be realized with other air suction reservoirs, for example with air suction reservoirs that have reservoir caps that are integrally formed with the reservoir walls of the same. When the first cylinder/cylindrical portion 156-1 is fitted into and fixed within the back portion 152 of the tube-shaped circular outer reservoir wall 155 of the air suction reservoir 150, the second cylinder/cylindrical portion 156-2 rests on the outer circumference of the back portion 152 of the tube-shaped circular reservoir wall 155 of the air suction reservoir 150. Expressed in other words, the second cylinder/cylindrical portion 156-2 rests on the outer rim of the back portion 152 of the tube-shaped circular outer reservoir wall 155.

A reservoir cap channel 157 which extends through the first and the second cylinder/cylindrical portions 156-1, 156-2 of the reservoir cap 156, allowing for air to flow from outside of the air suction reservoir 150 to an inside of the same. Expressed in other words, the reservoir cap 156 connects an air inlet 158 of the air suction reservoir 150, arranged on an outer side of the same, with a reservoir cap outlet 159, arranged inside the air suction reservoir 150 when the same is closed and sealed with the reservoir cap 156. The air inlet 158 of the reservoir cap 156 is arranged on a protrusion part, protruding from a side portion of the reservoir cap 156 of the periphery of the second cylinder/cylindrical portion 156-2 of the reservoir cap 156.

In this first embodiment of the case 200, the air suction reservoir 150 further comprises a stopper element 164 at the front portion 151 of the tube-shaped reservoir wall 155 of the air suction reservoir 150, forming a front end of the air suction reservoir 150. In this first embodiment, the front end of the air suction reservoir 150 is arranged facing the integrated slider portion 320 of the liquid cartridge 300. The stopper element 164 has the shape of a cap, having a diameter that is larger than the diameter of the tube-shaped reservoir wall 155, allowing for the stopper element 164 to be put over the front portion 151 of the tube-shaped reservoir wall 155, enclosing the outer peripheral rim of the tube-shaped reservoir wall 155 of the air suction reservoir 150.

The stopper element 164 has a central hole allowing for the threaded rod 162 of the plunger component 160 to pierce through the stopper element 164 and to protrude from the front portion 151 of the air suction reservoir 150. Expressed in other words, the threaded rod 162 of the plunger component 160 is tucked through the central hole within the stopper element 164 and extends beyond the air suction reservoir 150 and the stopper element 164. The plunger component 160 comprises a circular plunger 161 which has the shape of a piston and which is in contact with the inner sides of the tube-shaped circular reservoir wall 155 of the air suction reservoir 150. In more detail, the plunger 161 comprises a ring-shaped gasket element 330. An advantage of that may be that such a ring-shaped gasket element 330 allows for an air-tight division of the air-suction reservoir 150 into a first and a second chamber, enabling the suction of air via an air suction reservoir 150 that has the structure and functionality of a syringe. The ring-shaped gasket element 330 is arranged within a circular cavity that is positioned within the outer periphery, so within the circumference of the plunger 161 and that is in a constant contact with the inner sides of the tube-shaped circular reservoir wall 155. The plunger 161 is fitted into the tube-shaped circular reservoir wall 155 of the air suction reservoir 150 and is configured slidable along the inner sides of the tube-shaped circular reservoir wall 155. The plunger 161 separates a first chamber of the air suction reservoir 150 from a second chamber of the air suction reservoir 150, wherein the dimensions and the volumes of the two chambers of the air suction reservoir 150 are variable and depend on the position of the plunger 161 respectively. In the position of the plunger 161 shown in FIGS. 3 and 4, the volume of the first chamber is minimized while the volume of the second chamber is maximized. The plunger 161 provides for an air-tight separation between the first and the second variable chamber of the air suction reservoir 150. Expressed in other words, the plunger 161 can be pulled and pushed within the tube-shaped circular reservoir wall 155 of the air suction reservoir 150, altering the pressure within the first and the second chamber of the air suction reservoir 150. When the plunger 161 is moved from the position shown in FIGS. 3 and 4 to a position which is closer to the front portion 151 of the air suction reservoir 150, air is sucked into the first chamber of the air suction reservoir 150 via the air channel system 140.

In this first embodiment, the plunger component 160 comprises a threaded rod 162 that is attached to the plunger 161. In more detail, the plunger 161 comprises a central cavity for the reception of the threaded rod 162 which in this first embodiment is a rod with an outer screw thread thereon. The threaded rod 162 is inserted into the central cavity arranged within the plunger 161 and fixed thereto via a fixation component. However, in other embodiments, the threaded rod 162 can be connected to the plunger 161 via glue or via another connection element. Even in the position of the plunger 161 shown in FIGS. 3 and 4, the threaded rod 162 extends along the entire length of the air suction reservoir 150 and protrudes from the front portion/the stopper element 164 of the same. The threaded rod 162 extends in a direction that is parallel to the side walls 200*c*, 200*d*, 200*e*, 200*f* on the wide, narrow front a back side of the case 200. In this first embodiment, the actuation element 130 comprises a rotatable pump wheel 125 with an internal screw thread 126 arranged in engagement with the threaded rod 162, wherein the threaded rod 162 with the plunger 161 attached thereto is pulled or pushed within the air suction reservoir 150 depending on the direction of rotation of the rotatable pump wheel 125. An advantage of that may be that such a rotatable pump wheel 125 allows for an easy actuation of the pump mechanism in order to provide liquid from the liquid cartridge 300 to an electronic smoking device 10, 10*a* received by the primary receiving portion 101. Furthermore, the rotatable pump wheel 125 can be actuated by a user himself and is not dependent on an internal or an external power source. In more detail, in this first embodiment, the rotatable pump wheel 125 is arranged in between the air suction reservoir 150 and the secondary receiving portion 102. The rotatable pump wheel 125 is arranged in parallel to the cartridge cap 301, to the reservoir cap 156 and to the stopper element 164. The side wall 200*c* on the wide side of the case 200 comprises a cavity, wherein the rotatable pump wheel 125 protrudes through the cavity, being accessible from an outside of the case 200. The central axis of the rotatable pump wheel 125 is aligned with the threaded rod 162 of the plunger component 160, wherein the internal screw thread 126 of the rotatable pump wheel 125 is in engagement with the outer thread of the threaded rod 162. Expressed in other words, the rotatable pump wheel 125 comprises a central through hole with an internal screw thread 126 arranged therein. The dimensions and positioning of the air suction reservoir 150, of the plunger component 160 and of the rotatable pump wheel 125 are adjusted such that the threaded rod 162 is piercing through the central through hole of the rotatable pump wheel 125, notwithstanding the current position of the plunger component 160 within the air suction reservoir 150. Therefore, at least a predefined portion of the threaded rod 162 comprising the front end 162-1 of the threaded rod 162 constantly protrudes from the side of the rotatable pump wheel 125 facing the secondary receiving portion 102. When the rotatable pump wheel 125 is rotated, the internal screw thread 126 screws the external thread of the threaded rod 162, moving the threaded rod 162 and thereby the plunger component 160 in a longitudinal direction which is parallel to the direction of extension of the reservoir wall 155 of the air suction reservoir 150, so either towards the cartridge cap 301 of the liquid cartridge 300, or towards the reservoir cap 156, depending on the direction of rotation of the rotatable pump wheel 125. Thus, via a rotation of the rotatable pump wheel 125, the pump system 120 is actuated and air is sucked into the air suction reservoir 150 when the rotatable pump wheel 125 is rotated into a direction causing the threaded rod 162 and the plunger 161 thereon to move closer towards the cartridge cap 301 when a liquid cartridge 300 is inserted therein. The direction of the longitudinal movement of the plunger 161 due to a clockwise rotation of the rotatable pump wheel 125 depends on the kind of engagement of the internal screw thread 126 and the outer thread of the threaded rod 162.

In this first embodiment, as shown in FIG. 3, a cap element 163 is attached to the front end 162-1 of the threaded rod 162, wherein the shape of the cap element 163 is corresponding to the shape of the reception cavity 340 of the integrated slider portion 320 of a liquid cartridge 300 inserted into the secondary receiving portion 102. Expressed in other words, the cap element 163 fixed onto the front end 162-1 of the threaded rod 162 fits into the reception cavity 340 of the integrated slider portion 320 of a liquid cartridge 300 inserted into the secondary receiving portion 102.

Thus, when the rotatable pump wheel 125 is rotated in a direction causing the front end 162-1 of the threaded rod 162 to move closer to the secondary receiving portion 102 and closer to the cartridge cap 301 of a liquid cartridge 300 inserted into the secondary receiving portion 102, the integrated slider portion 320 is actuated via the threaded rod 162, pushing liquid within the liquid cartridge 300 out of the same via the cartridge outlet 310. The rotatable pump wheel 125 can be rotated in this direction until the plunger 161 of the plunger component 160 contacts the stopper element 164 of the air suction reservoir 150, with the first chamber of the air suction reservoir 150 having the maximum dimension. In this position of the plunger 160, the threaded rod 162 protrudes out of the air suction reservoir 150 to a maximum extent, having pushed the integrated slider portion 320 of the liquid cartridge 300 within the secondary receiving portion 102 up to the cartridge cap 301 of the liquid cartridge 300. In this state of the threaded rod 162, the liquid that was contained within the liquid cartridge 300 has been fully ousted out of the cartridge outlet 310 and the liquid cartridge 300 either needs to be replaced or refilled.

Figure 7:
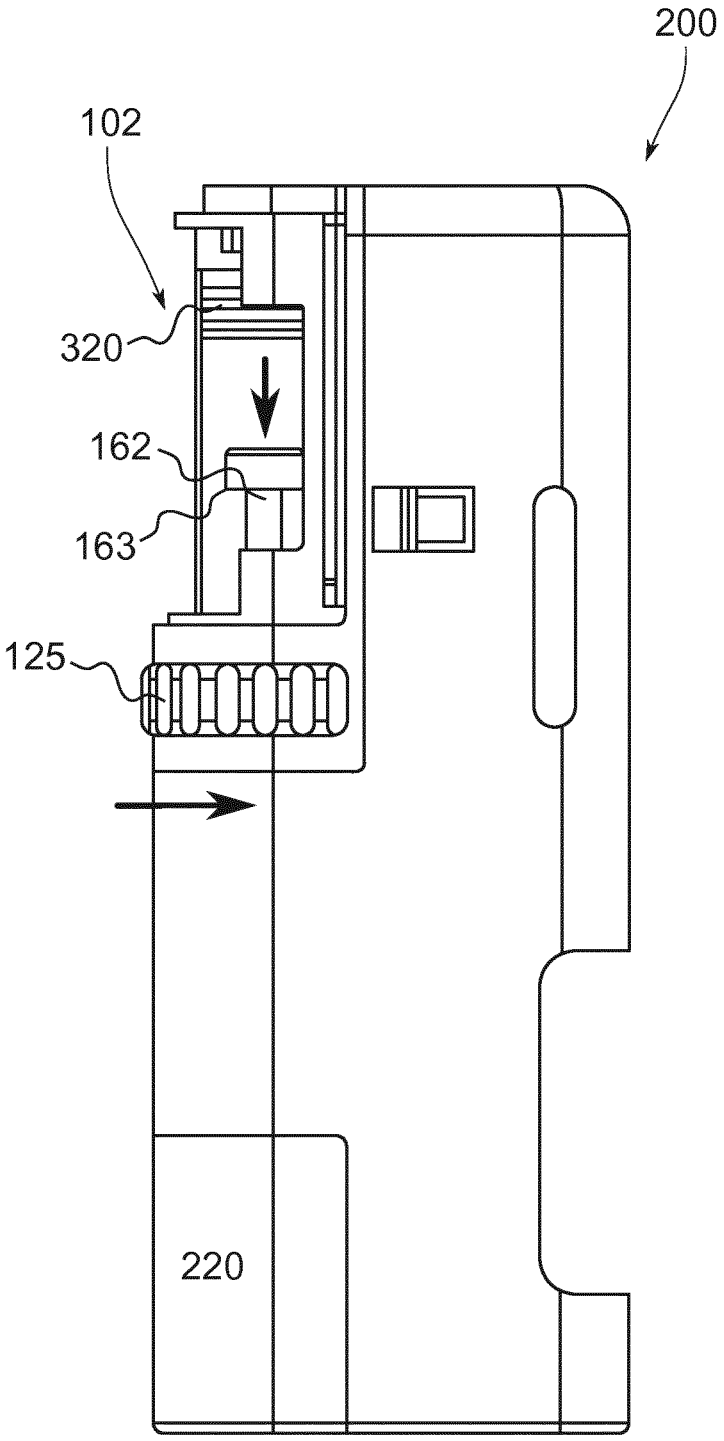
FIG. 7 shows a schematic perspective illustration of the first embodiment of the case during the replacement procedure of the liquid cartridge.

When the rotatable pump wheel 125 is rotated into the opposite direction, the threaded rod 162 with the plunger 161 thereon is pulled back into the air suction reservoir 150. In order to replace the liquid cartridge 300 with another cartridge as shown in the FIGS. 5*a* to 5*e*, the threaded rod 162 needs to be pulled back to a full extent, so that the pump system 120 is brought to the refill state mentioned hereinbefore. This is indicated in FIG. 7, where the first embodiment of the case 200 is shown during a liquid cartridge 300 replacement procedure as shown in the FIGS. 5*a* to 5*e*. In FIG. 7, the direction of rotation of the rotatable pump wheel 125 and the corresponding movement of the threaded rod 162 are indicated by arrows. When the plunger component 160 and especially the threaded rod 162 is brought to the refill state as shown in FIGS. 3 and 4, the emptied liquid cartridge 300 can be replaced with a new liquid cartridge 300. Furthermore, the case 200 comprises a support component 177. The support component 177 is arranged in between the reservoir cap 156 of the air suction reservoir 150 and an inner side of the lower sidewall 200*a* and serves to apply a force onto the reservoir cap 156 in order to provide for an air-tight connection between the reservoir cap 156 and the circular reservoir wall 155 of the air suction reservoir 150. Furthermore, in this first embodiment of the case 200, the portions of the side walls 200*a*, 200*c*, 200*e*, 200*f* of the case 200 which form the lower corner of the case 200 enclosing the support component 177, together form an integral lower corner part 220 of the case 200 that is configured detachable from the case 200. In this first embodiment, the lower corner part 220 of the case 200 can be slid off the case 200 in a downwards direction which in FIGS. 3 and 4 is indicated by an arrow. This allows for an eased insertion or replacement of the support component 177.

As can be seen in FIGS. 3 and 4, the case 200 comprises a liquid cartridge 300 received by the secondary receiving portion 102, the liquid cartridge 300 comprising a cartridge outlet 310, connected to the liquid inlet 111. Furthermore, the case 200 comprises an integrated slider portion 320 which is configured slidable along the inner sides of the walls 305 of the liquid cartridge 300, the integrated slider portion 320 being arranged and configured to be moved by a front portion 151 of the threaded rod 162 protruding from the air suction reservoir 150. An advantage of that may be that the case 200 itself does not need to be refilled with a liquid which is complicated and may cause the liquid to be spilled during the refill procedure. Instead, a liquid cartridge 300 containing the liquid easily can be inserted into the secondary receiving portion 102 which is safer and cleaner. However, also other cases without such liquid cartridges 300 can be realized. Such other cases can comprise such separate liquid reservoirs as the aforementioned.

In this first embodiment, the case 200 further comprises a connection interface 180 connectable to the liquid outlet 112 of the liquid channel system 110, wherein the connection interface 180 is configured movably between a first and a second position, the connection interface 180 comprising a first and a second hollow needle element 181, 182, each adapted to be inserted into a corresponding refill interface of an electronic smoking device 10, 10*a* received by the primary receiving portion 101. An advantage of that may be that the connection between the case 200 and an electronic smoking device that is inserted into the primary receiving portion 101, in order to refill the liquid reservoir of the electronic smoking device, is eased. Via the moveable connection interface 180, the electronic smoking device or a liquid reservoir thereof can easily be connected to the liquid channel system 110 and thereby to the liquid cartridge 300. The connection interface 180 is positioned adjacent the primary receiving portion 101 with the first and the second hollow needle element 181, 182 being arranged perpendicular to the central axis of the elongated cavity CLc of the primary receiving portion 101 respectively.

Figure 8A:
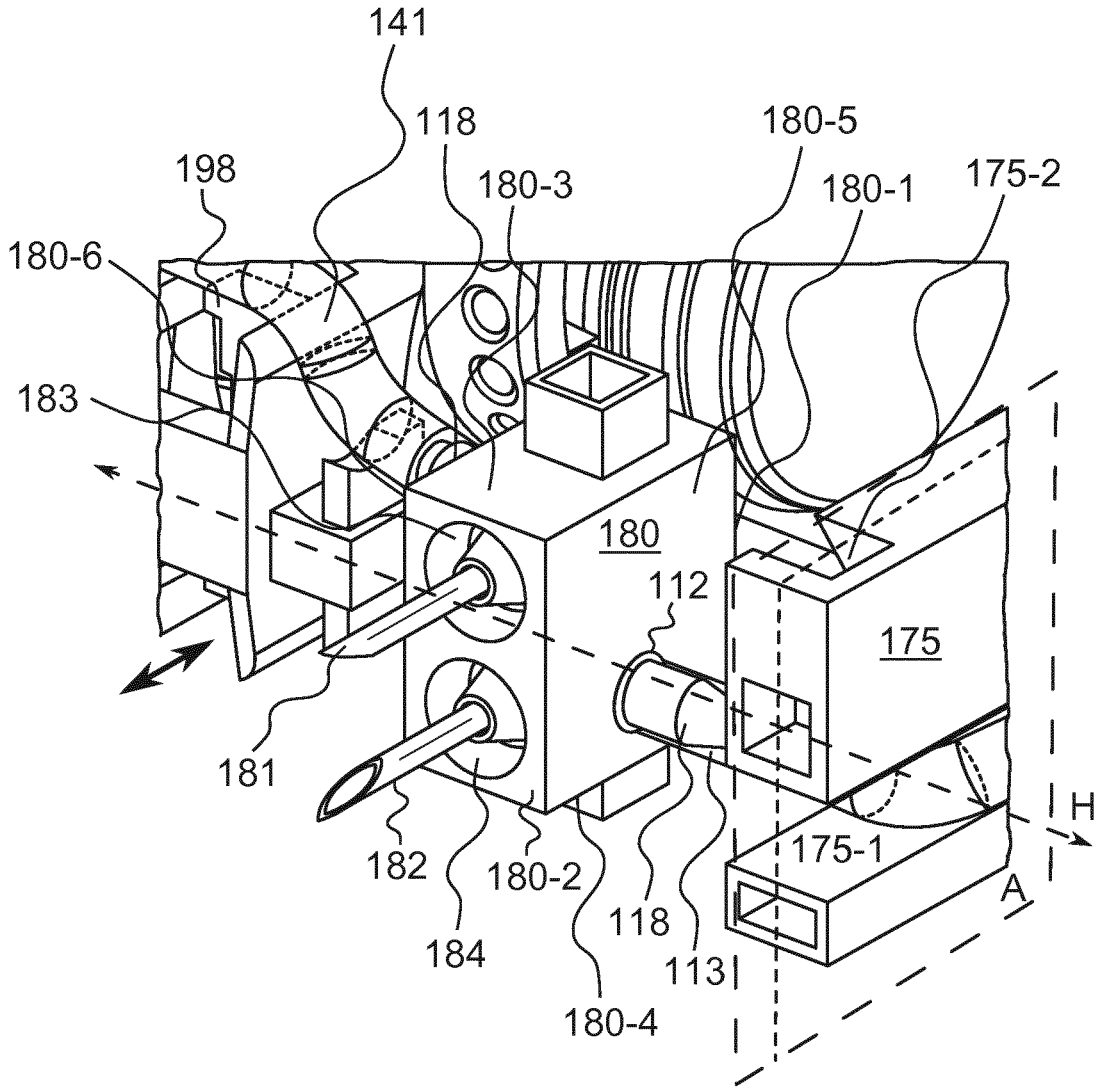
FIG. 8*a* shows a schematic perspective view of a cut free connection interface of the first embodiment of the case.
Figure 8B:
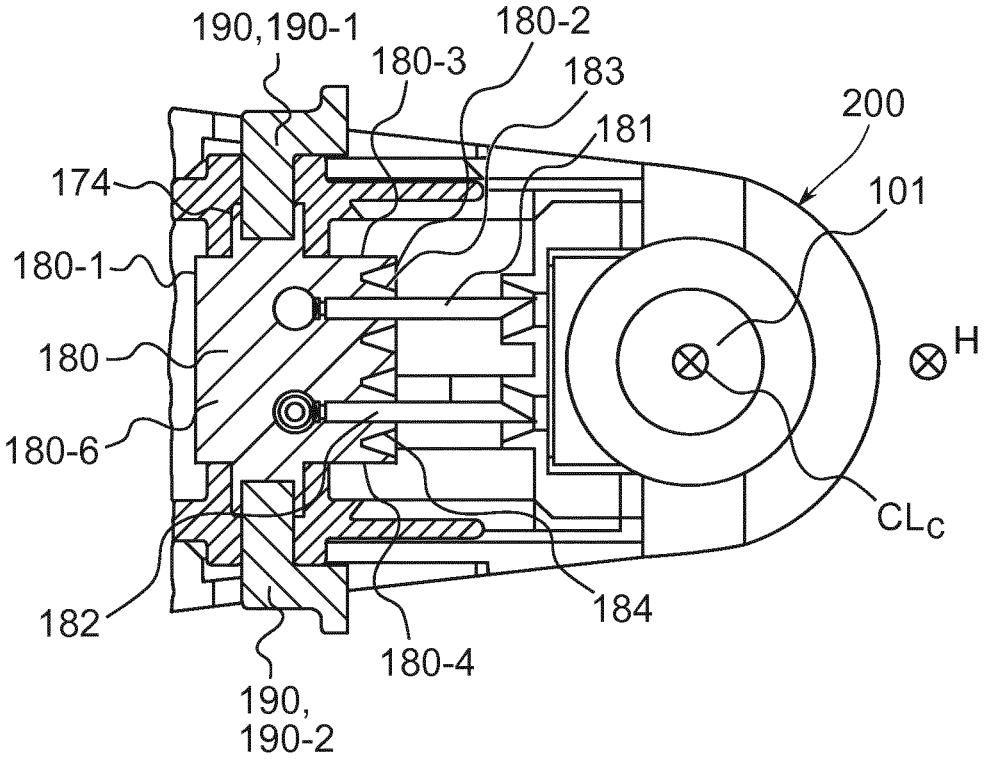
FIGS. 8*b* and 8*c* both show a section of a schematic cross-section of the case, the cross-section being perpendicular to the height of the case respectively.
Figure 8C:
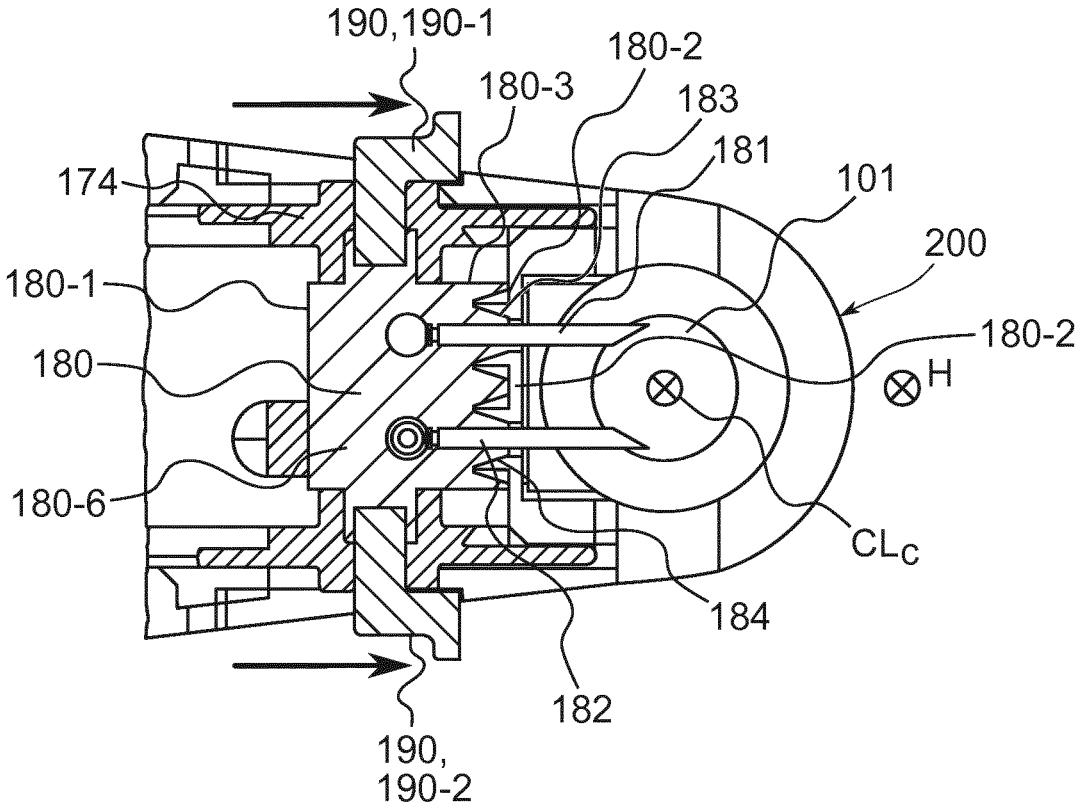

In FIGS. 8*a*, 8*b* and 8*c*, the connection interface 180 and the arrangement of the same is shown in greater detail. In FIG. 8*a*, a perspective view of a cut free connection interface 180 is shown, wherein in the FIGS. 8*b* and 8*c*, a section of a cross-section of the case 200 is shown, the cross-section being perpendicular to the height H of the case 200. As can be seen in FIG. 8*a*, the connection interface 180 comprises a box-shaped, rectangular body, substantially having the shape of a cuboid. The rectangular body is positioned adjacent the secondary receiving portion 102 and has a back side 180-1 facing the secondary receiving portion 102 and a front side 180-2 facing the primary receiving portion 101 of the case 200. The front side 180-2 and the back side 180-1 of the box-shaped, rectangular body of the connection interface 180 each comprise two long edges and two short edges, wherein the short edges are arranged parallel to the height H of the case 200 and wherein the long edges are arranged perpendicular to the height H of the case 200. The front side 180-2 of the box-shaped, rectangular body of the connection interface 180 has two circular cavities 183, 184 which are arranged within the center of the front side 180-2 respectively, along the long edges of the same. The first hollow needle element 181 is arranged within the first circular cavity 183, wherein the second hollow needle element 182 is arranged within the second circular cavity 184, both needle elements 181, 182 protruding from the front side 180-2 of the connection interface 180. The two circular cavities 183, 184 both comprise a nozzle component arranged within the respective circular cavity 183, 184, being integrally formed with the same respectively. Expressed in other words, the first and the second hollow needle elements 181, 182 are arranged within a conic body respectively, the conic bodies being positioned within the circular cavities 183, 184 respectively, with the tapering end of the conic bodies pointing towards the primary receiving portion 101 respectively.

The box-shaped, rectangular body further comprises a top side 180-3 and a bottom side 180-4, interconnecting the front side 180-2 and the back side 180-1 of the box-shaped, rectangular body of the connection interface 180. On both the top side 180-3 and the bottom side 180-4, a rectangular reception frame is arranged, adapted to receive a lever element (not shown in FIG. 8*a*) respectively. The reception frames protrude from the front side 180-2 and the back side 180-1 of the box-shaped rectangular body of the connection interface 180 and are adapted to receive a rectangular counterpart respectively. Moreover, the box-shaped, rectangular body of the connection interface 180 comprises a first and a second side wall 180-5, 180-6, the first side wall 180-5 facing towards the upper side 200*b* of the case 200, while the second side wall 180-6 is facing towards the lower sidewall 200*a* of the case 200. Within the first side wall 180-5 of the box-shaped, rectangular body of the connection interface 180, there is arranged a connection opening for the second hollow needle element 182, allowing for the connection of the liquid outlet 112 of the liquid channel system 110 with the second hollow needle element 182, so that liquid can flow from the liquid channel system 110 into and out of the second hollow needle element 182. Moreover, within the second side wall 180-6 of the box-shaped, rectangular body of the connection interface 180, there is arranged a connection opening for the first hollow needle element 181, allowing for the connection of the air channel system 140 with the first hollow needle element 181 so that air entering the first hollow needle element 181 can flow into the air channel system 140. In more detail, in this first embodiment, the first hollow needle element 181 is connected to the air channel system 140, adapted to transport air from the first hollow needle element 181 to the air suction reservoir 150. An advantage of that may be that air which is ousted out of the liquid reservoir of an electronic smoking device during a refill process of the same will reliably be transported from the liquid reservoir of the electronic smoking device into the air suction reservoir 150 of the case 200 via the first hollow needle element 181 of the connection interface 180. The connection openings in the first and second side wall 180-5, 180-6 each comprise a nozzle connection piece 118, protruding from their respective first and second side wall 180-5, 180-6 into a direction which is perpendicular to the direction of extension of the first and second needle element 181, 182 respectively.

As can be seen in FIGS. 4 and 8*a*, the air channel system 140 comprises an air channel component 141, which connects the connection opening in the second side wall 180-6 of the box-shaped, rectangular body of the connection interface 180 with the air inlet 158 of the air suction reservoir 150 (see FIG. 3). In this first embodiment, the liquid channel system 110 comprises a liquid channel component 113 which is shown in FIG. 8*a*. The liquid channel component 113 is connected to the aforementioned liquid inlet 111 of the liquid channel system 110. The air channel component 141 and the liquid channel component 113 in this first embodiment are both realized as air-tight and flexible channels which exemplarily comprise a flexible plastic material respectively. However, also other embodiments of cases with other channel components can be realized. In this first embodiment, a flow of liquid from the liquid inlet 111 of the liquid channel system 110 to the second hollow needle element 182 is enabled when the connection interface 180 is in the first position and wherein the flow of liquid from the liquid inlet 111 of the liquid channel system 110 to the second hollow needle element 182 is reduced or interrupted when the connection interface 180 is in the second position. An advantage of that may be that liquid cannot be expelled via the second hollow needle element 182 when the connection interface 180 is in the second position. Expressed in other words, in this first embodiment, liquid can only be expelled via the second hollow needle element 182 when the connection interface 180 is in the first position. This will efficiently prevent a spilling of liquid. Furthermore, the flow of liquid at the liquid outlet 112 and therefore the liquid channel system 110 of the case 200 is blocked when the connection interface 180 is not protruding into the primary receiving portion 101 and especially when it is not connected to an electronic smoking device inserted into the primary receiving portion 101 which will be described further hereinafter. Furthermore, the flow of liquid is enabled when the connection interface 180 is protruding into the primary receiving portion 101 and therefore connected to an electronic smoking device correctly inserted into the primary receiving portion 101.

Expressed in other words, the connection interface 180 comprising the box-shaped, rectangular body with the liquid channel component 113, the air channel component 141 and the first and second hollow needle elements 181, 182 thereon is moveable back and forth in a direction that is perpendicular to the height H of the case 200, the direction of the movement being indicated with a black double arrow in FIG. 8*a*. In more detail, the connection interface 180 is moveable relative to the other immovable components of the case 200, for example relative to the air suction reservoir 150 or to the secondary and primary receiving portions 101, 102. In FIGS. 8*b* and 8*c*, a section of a cross-section of the case 200 perpendicular to the height H of the case 200 is shown respectively. In more detail, the section shows a cross-section through the connection interface 180 and the primary receiving portion 101, adapted to receive the electronic smoking device 10*a* shown in FIG. 2. Moreover, also other components are shown in the FIGS. 8*b* and 8*c* that have been omitted in FIG. 8*a* for the sake of a better understanding. One of these components is the lever element 190 which comprises two separate lever components 190-1, 190-2. A first lever component 190-1 comprises a rectangular counterpart that is received by the rectangular reception frame arranged on the top side 180-3 of the box-shaped, rectangular body of the connection interface 180. The second lever component 190-2 comprises a rectangular counterpart that is received by the rectangular reception frame arranged on the bottom side 180-4 of the box-shaped, rectangular body of the connection interface 180. The counterparts of the lever components 190-1, 190-2 are fixed within their respective rectangular reception frame on the top and bottom side 180-3, 180-4 of the box-shaped, rectangular body of the connection interface 180.

Both the first and the second lever components 190-1, 190-2 protrude out of a respective cavity arranged within the first part and the second part 200-1, 200-2 of the case 200 respectively. The first lever component 190-1 protrudes out of the side wall 200*e* on the front side of the case 200 while the second lever component 190-2 protrudes out of the side wall 200*f* on the back side of the case 200. Thus, both the first and the second lever components 190-1, 190-2 are accessible by a user from an outside of the case 200, allowing for a movement of the connection interface 180 positioned within the case 200. The first lever component 190-1 protruding out of the side wall 200*e* on the front side of the case 200 is also visible in FIG. 4.

Furthermore, the case 200 comprises a slide frame component 174 which can be seen in FIG. 4 and in FIGS. 8*b* and 8*c*. The connection interface 180 is held by the slide frame component 174 which is configured slidable along corresponding sliding cavities provided by supporting walls arranged within the case (see also FIG. 4). Thus, the slide frame component 174 together with the connection interface 180 therein can be slid along the sliding cavities within the supporting walls, moving the connection interface 180 between the first and the second position. As can be seen in FIG. 4, and FIGS. 8*b* and 8*c*, the slide frame component 174 has a top and a bottom wall. The top wall of the slide frame component 174 is in contact with the top side 180-3 of the box-shaped, rectangular body of the connection interface 180 and wherein the bottom wall of the slide frame component 174 is in contact with the bottom side 180-4 of the box-shaped, rectangular body of the connection interface 180. The top and bottom wall of the slide frame component 174 each comprise a cavity for the lever components 190-1, 190-2 protruding through these cavities respectively. Furthermore, the slide frame component 174 comprises two side walls which interconnect the top and bottom of the same respectively. The two side walls of the slide frame component 174 are arranged in a distance to one another and to the first and second side wall 180-5, 180-6 of the box-shaped, rectangular body of the connection interface 180 respectively, such that the aforementioned supporting walls with the sliding cavities therein reach into the space between the box-shaped, rectangular body and the two side walls of the slide frame component 174 respectively (see FIG. 4). Thus, in this first embodiment, the case 200 comprises a lever element 190 that is connected to the connection interface 180 and accessible from outside of the case 200, wherein the connection interface 180 is moveable between the first and the second position upon an actuation of the lever element 190. An advantage of that may be that a movement of the connection interface 180 within the case 200 can easily be performed by simply actuating the lever element 190 protruding out of the case 200.

In this first embodiment, the primary receiving portion 101 comprises a cavity for the reception of the outer refill interface 33 of the electronic smoking device 10, 10*a* inserted into the primary receiving portion 101. The cavity substantially has a trapezoidal shape corresponding to the trapezoidal shape of the outer refill interface 33 of the electronic smoking device 10, 10*a* (see FIGS. 1 and 2). Furthermore, funnel-shaped insertion aid cavities are arranged consecutively to the trapezoidal-shaped cavity and connected to the same. The funnel-shaped insertion aid cavities correspond to the nozzle components arranged within the two circular cavities 183, 184 of the box-shaped, rectangular body of the connection interface 180 respectively. Therefore, when the connection interface 180 is moved from the second position to the first position, the insertion of the first and the second hollow needle elements 181, 182 into the first and second separate openings 33-1, 33-2 of the outer refill interface 33 of the electronic smoking device 10, 10*a* (see FIGS. 1 and 2) inserted into the primary receiving portion 101 is eased, as the first and second hollow needle elements 181, 182 are guided into the respective openings via the funnel-shaped insertion aid cavities.

In FIG. 8*b*, the connection interface 180 is in the second position with the connection interface 180 being retracted from the primary receiving portion 101. In this second position, the first and the second hollow needle elements 181, 182 are arranged within their respective funnel-shaped insertion aid cavity, but do not protrude into the trapezoidal-shaped cavity and do not protrude into the primary receiving portion 101 of the case 200. In this second position, a flow of liquid to the second hollow needle element 182 is inhibited which is not visible in FIG. 8*b* but which will be described further with respect to FIGS. 9*a* and 9*b* hereinafter. In FIG. 8*c*, the connection interface 180 is in the first position, wherein the movement of the connection interface 180 from the second position to the first position in FIG. 8*c* is indicated by two arrows. In this first position, the connection interface 180 is extracted with the first and second hollow needle elements 181, 182 protruding into the trapezoidal-shaped cavity and into the primary receiving portion 101. In this first position, the funnel-shaped insertion aid cavities are engaged with the nozzle components arranged within the two circular cavities 183, 184 of the box-shaped, rectangular body of the connection interface 180 respectively. When the electronic smoking device 10, 10*a* is inserted into the primary receiving portion 101, the first and the second hollow needle element 181, 182 are inserted into the first and second separate opening 33-1, 33-2 of the outer refill interface 33 of the electronic smoking device 10, 10*a* (see FIGS. 1 and 2) and the liquid reservoir 34 of the electronic smoking device 10, 10*a* can be refilled via an actuation of the pump system 120. Expressed in other words, the first and the second hollow needle element 181, 182 protrude into the primary receiving portion 101 when the connection interface 180 is in the first position and wherein the first and the second hollow needle element 181, 182 are retracted from the primary receiving portion 101 when the connection interface 180 is in the second position. An advantage of that may be that the insertion of an electronic smoking device 10, 10*a* into the primary receiving portion 101 of the case 200 is eased, as in the second position, no element or component of the case 200 protrudes into the primary receiving portion 101 of the case 200 so that the electronic smoking device 10, 10*a* can easily be slid into the primary receiving portion 101.

Figure 9A:
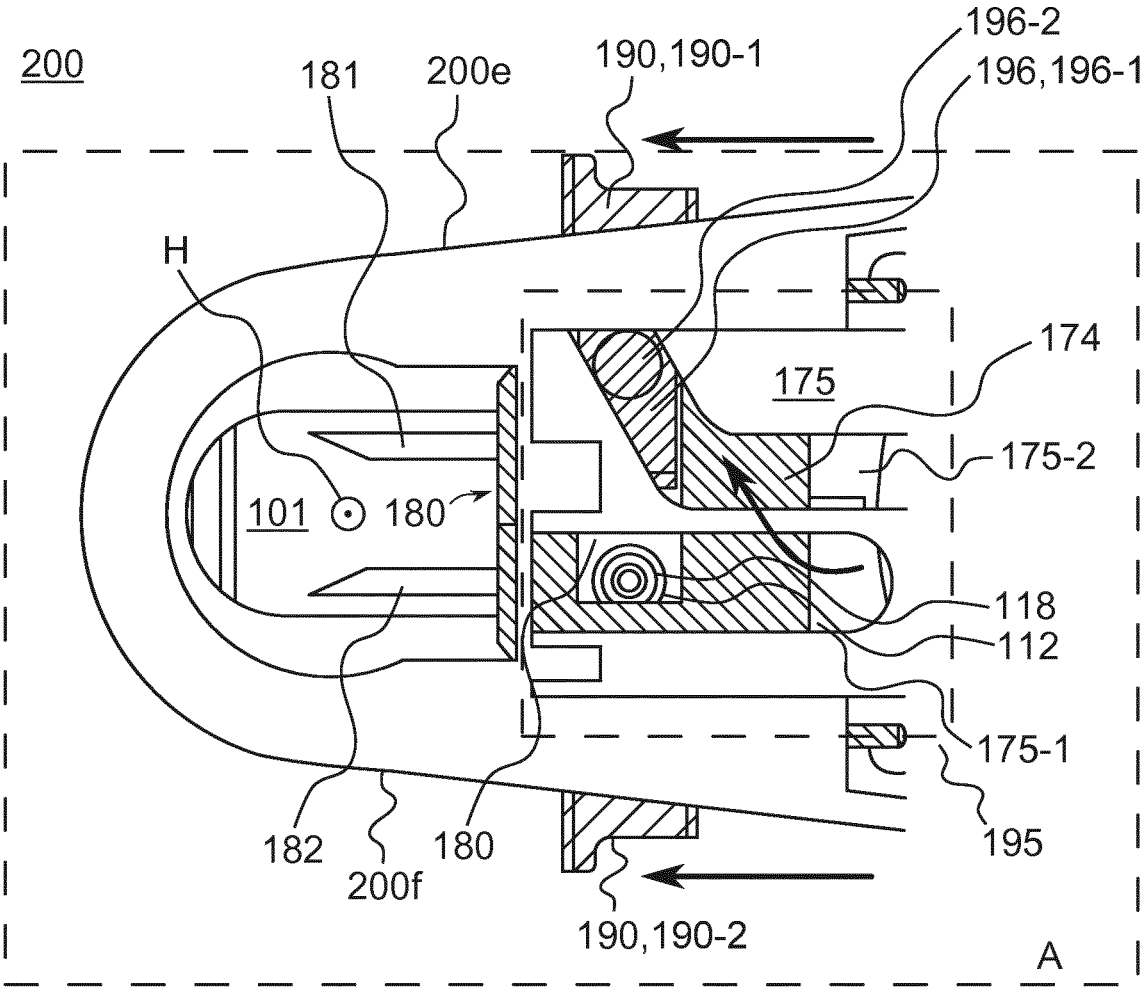
FIGS. 9*a* and 9*b* show the section of a schematic cross-section of the case as shown in FIGS. 8*b* and 8*c* from a different perspective and at different positions of the connection interface of the first embodiment of the case.
Figure 9B:
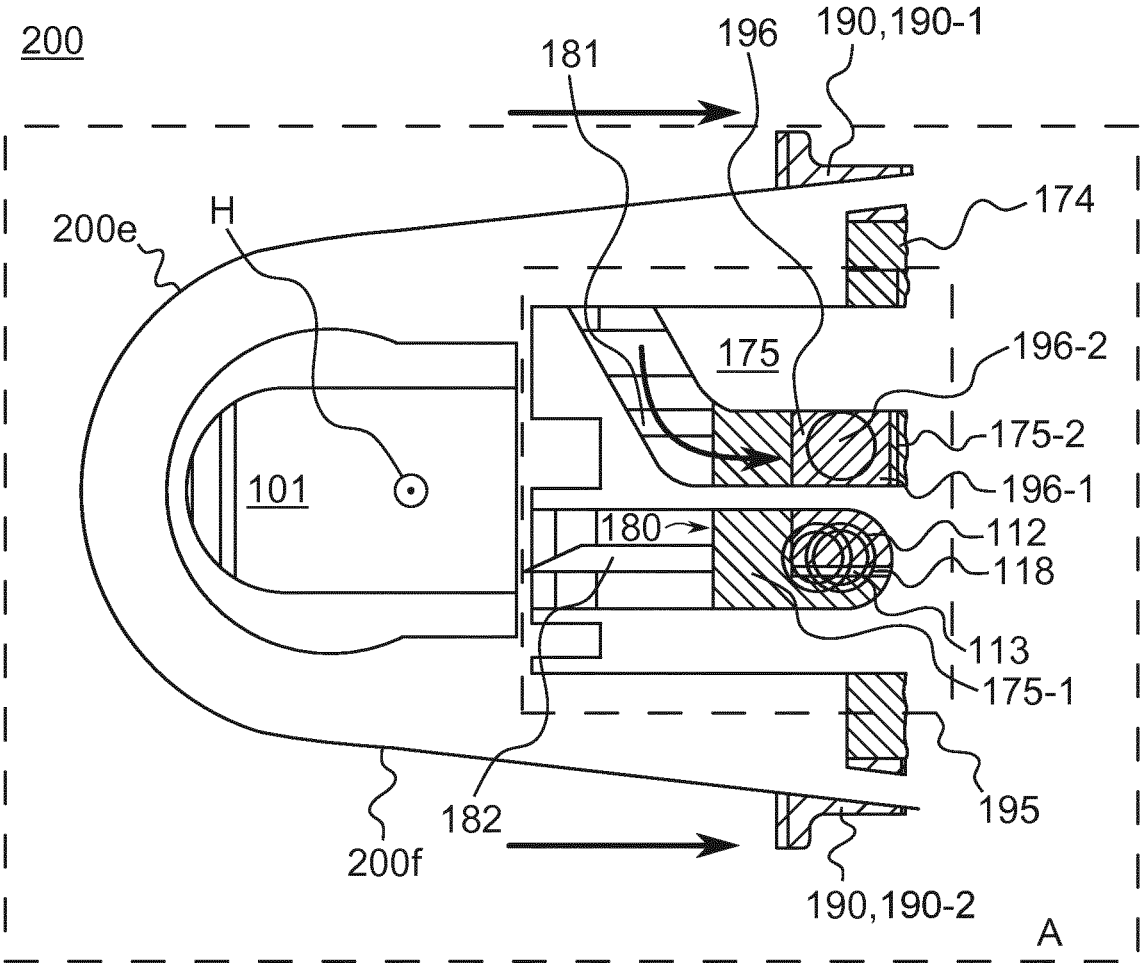

FIGS. 9*a* and 9*b* each show a section of a cross section of the case 200, showing the connection interface 180 and the adjacent parts interacting with the connection interface 180 from a different perspective. In more detail, FIGS. 9*a* and 9*b* show a cross section through the primary receiving portion 101 along a plane A which is indicated in FIG. 8*a*, wherein in FIGS. 9*a* and 9*b*, also the further components adjacent to the connection interface 180 are shown which in FIG. 8*a* have been omitted for the sake of a better understanding. Expressed in other words, FIGS. 9*a* and 9*b* show the section of the cross section shown in FIGS. 8*b* and 8*c* from the opposing side, giving the viewer an insight into the primary receiving portion 101 with a direct view onto the inner side of the lower sidewall 200*a* of the case 200. In FIG. 9*a*, the connection interface 180 is in the first position. Thus, the first and the second hollow needle element 181, 182 protrude into the primary receiving portion 101 respectively. Furthermore, the first and the second lever component 190-1, 190-2 of the lever element 190 are shown, the components 190-1, 190-2 protruding out of the side walls 200*e*, 200*f* on the front side and the back side of case 200. Via two arrows shown directly adjacent to the lever components 190-1, 190-2, the direction of the actuation of the lever element 190 in order to bring the connection interface 180 from the second position into the first position is indicated.

In the section of the cross-section shown in FIG. 9*a*, only a small fraction of the rectangular, box shaped body of the connection interface 180 is visible, as the slide frame component 174, a further guide rail component 175 arranged adjacent to the slide frame component 174 and a first blocking element 196 movably arranged within an outer side of the slide frame component 174 are blocking the view on the main part of the box-shaped, rectangular body of the connection interface 180. In this first embodiment, both the guide rail component 175 and the first blocking element 196 form part of a locking system 195. Expressed in other words, in this first embodiment, the case 200 further comprises a locking system 195, the locking system 195 being coupled to the lever element 190 and adapted to prevent a supply of liquid to the second hollow needle element 182 of the connection interface 180 when the connection interface 180 is in the second position. An advantage of that may be that liquid is not transported to the second hollow needle element 182 when the connection interface 180 is in the second position. In order to allow for liquid to flow from a liquid cartridge 300 inserted into the secondary receiving portion 102 to the second hollow needle element 182, the connection interface 180 needs to be moved to the first position. Therefore, via the locking system 195, spilling of liquid is further prevented. The guide rail component 175 is arranged next to the slide frame component 174 and can be seen in the FIGS. 3, 4, 8*a*, 9*a* and 9*b*. Other than the slide frame component 174, the guide rail component 175 is fixed within the case 200 and extends from the secondary receiving portion 102 of the case 200 to the primary receiving portion 101 of the same. The guide rail component 175 comprises a substantially rectangular body with two guide rail cavities 175-1, 175-2 therein. As can be seen in FIGS. 3 and 4, the guide rail component 175 is arranged between the cartridge interface element 115 and the slide frame component 174 enclosing the connection interface 180. As visible in FIGS. 9*a* and 9*b*, the first guide rail cavity 175-1 allows for the liquid channel component 113 to be fed through the guide rail component 175 and to be moved sideways in a direction corresponding to the direction of the movement of the connection interface 180. Thus, the first guide rail cavity 175-1 has an elongated, linear shape that corresponds to the liquid channel component 113 and longitudinally extends from a center portion of the guide rail component 175 to the primary receiving portion 101 of the case 200. At the end closest to the primary receiving portion 101 of the case 200, the first guide rail cavity 175-1 has an open end which faces the primary receiving portion 101. The second guide rail cavity 175-2 is arranged adjacent to the first guide rail cavity 175-1 and has a curved shape. In more detail, the second guide rail cavity 175-2 is curved in an upwards direction, comprising a first portion that is parallel to the first guide rail cavity 175-1 and a second portion that encloses an angle with the first portion of the second guide rail cavity 175-2, pointing away from the first guide rail cavity 175-1.

The first guide rail cavity 175-1 is arranged within the guide rail component 175, such that the nozzle connection piece 118 of the connection opening and the liquid outlet 112 of the channel component 113 connected to the second hollow needle element 182 in the first side wall 180-5 of the box-shaped, rectangular body of the connection interface 180 and the first guide rail cavity 175-1 are arranged in a common plane that is parallel to the height H of the case 200 and parallel to the direction of extension of the first guide rail cavity 175-1. Expressed in other words, the nozzle connection piece 118 of the connection opening for the second hollow needle element 182 and the first guide rail cavity 175-1 are positioned along a line which is parallel to the height H of the case 200. The liquid channel component 113—as shown in FIG. 8*a*—extends along the direction of extension of the nozzle connection piece 118. The second, boomerang-shaped guide rail cavity 175-2 serves as a guide rail for a first blocking element 196.

In this first embodiment, the locking system 195 comprises a first blocking element 196, the first blocking element 196 being adapted to interact with the liquid channel component 113 when the connection interface 180 is in the second position, thereby blocking a flow of liquid to the second needle element 182. An advantage of that may be that the first blocking element 196 physically blocks the liquid channel component 113 and interrupts the flow of liquid, which safely prevents a spilling of liquid, for example when the electronic smoking device 10, 10*a* is removed from the primary receiving portion 101. The first blocking element 196 comprises a plate-shaped base part 196-1 with a circular, cylindrical-shaped protrusion 196-2 thereon. The plate-shaped base part 196-1 is arranged within a rectangular cavity arranged within an outer side of the side wall of the slide frame component 174, the outer side of the side wall of the slide frame component 174 facing towards the guide rail component 175 and the upper sidewall 200*b* of the case 200. The plate-shaped base part 196-1 is configured slidable within the rectangular cavity arranged within an outer side of the side wall of the slide frame component 174. The rectangular cavity within the side wall of the slide frame component 174 extends in a direction which is perpendicular to the first guide rail cavity 175-1 arranged within the guide rail component 175 and perpendicular to the direction of movement of the connection interface 180. Thus, the first blocking element 196 is configured movably along a direction which is perpendicular to the direction of movement of the connection interface 180. In this first embodiment, the liquid channel component 113 of the liquid channel system 110 is also fed through the rectangular cavity that is arranged within the side wall of the slide frame component 174. Thus, the liquid channel component 113 allows for a flow of liquid through the first guide rail cavity 175-1 and through the rectangular cavity that is arranged within the side wall of the slide frame component 174.

The circular, cylindrical-shaped protrusion 196-2 that is arranged on the plate-shaped base part 196-1 of the first blocking element 196 is arranged within the second guide rail cavity 175-2. Expressed in other words, as the outer side of the side wall of the slide frame component 174 borders on the guide rail component 175, the circular, cylindrical-shaped protrusion 196-2 that is arranged on the plate-shaped base part 196-1 of the first blocking element 196 protrudes into the second guide rail cavity 175-2. Thus, when the connection interface 180 with the slide frame component 174 is moved between the first and the second position, the first blocking element 196 arranged within the rectangular cavity of the slide frame component 174 is dragged along, wherein the position of the first blocking element 196 within the rectangular cavity depends on the position of the circular, cylindrical-shaped protrusion 196-2 within the second guide rail cavity 175-2. Thus, as the liquid channel component 113 is fed through the rectangular cavity arranged within the guide rail component 175, the first blocking element 196 serves as a moveable blocking flap which is adapted to squeeze the liquid channel component 113 in order to the prevent liquid to flow from the liquid inlet 111 to the liquid outlet 112 and the second hollow needle element 182 when the connection interface 180 is moved to the second position. Expressed in other words, the first blocking element 196—just like a guillotine—is adapted to be pushed onto the liquid channel component 113 in order to substantially reduce the cross-section of the liquid channel component 113, preventing liquid from flowing through the liquid channel component 113 when the connection interface 180 is brought to the second position.

In FIG. 9*a*, the connection interface 180 is shown in the first position. In this first position, the first blocking element 196 is slid up the second guide rail cavity 175-2, releasing the liquid channel component 113 so that liquid from a liquid cartridge 300 arranged within the secondary receiving portion 102 can flow through the liquid channel component 113 and to the liquid outlet 112 of the liquid channel system 110. In FIG. 9*a*, the movement of the first blocking element 196—especially of the circular, cylindrical-shaped protrusion 196-2—along the second guide rail cavity 175-2 when the connection interface 180 is moved from the second to the first position is indicated by a curved arrow. In FIG. 9*b*, the connection interface 180 is shown in the second position, being retracted from the primary receiving portion 101. In this second position, the first blocking element 196 is slid down the second guide rail cavity 175-2, squeezing the liquid channel component 113 so that liquid from a liquid cartridge 300 arranged within the secondary receiving portion 102 cannot flow through the liquid channel component 113 and to the liquid outlet 112 of the liquid channel system 110. In other embodiments, liquid can flow through the liquid channel component 113 and to the liquid outlet 112 of the liquid channel system 110, but the flow of liquid is substantially reduced. Also in FIG. 9*b*, the movement of the first blocking element 196—especially of the circular, cylindrical-shaped protrusion 196-2—along the second guide rail cavity 175-2 when the connection interface 180 is moved from the first to the second position is indicated by a curved arrow. The squeezing of the liquid channel component 113 is not shown in FIG. 9*b*. However, it can be seen that the space that is left between the first blocking element 196 and the rectangular cavity arranged within the outer side of the side wall of the slide frame component 174 for liquid to flow through is substantially reduced. Furthermore, it is indicated in FIG. 9*b* that the liquid channel component 113 is—following the movement of the connection interface 180—dragged along the first guide rail cavity 175-1 arranged within the guide rail component 175.

Figure 10A:
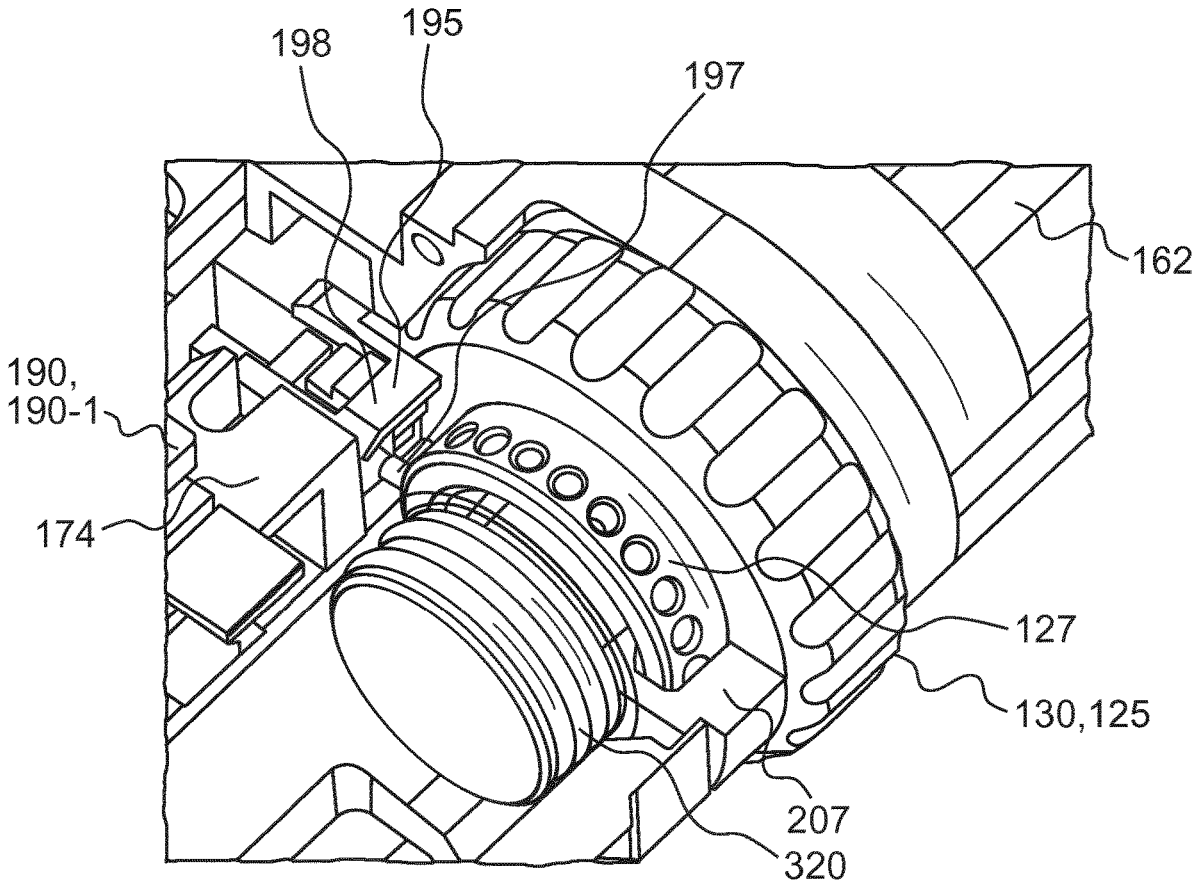
FIG. 10*a* shows a schematic perspective view on a second blocking element of the locking system of the first embodiment of the case arranged adjacent to the rotatable pump wheel.
Figure 10B:
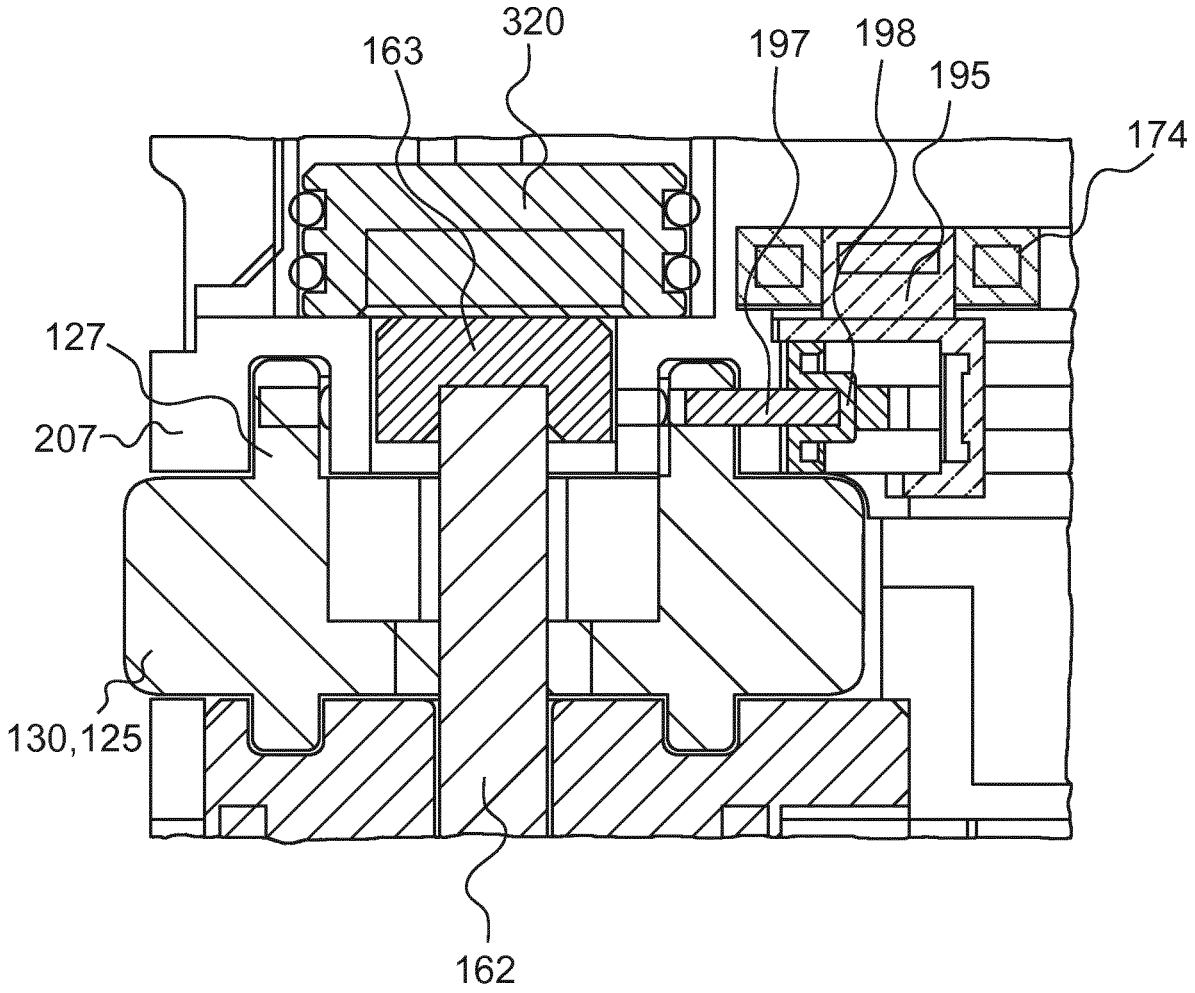
FIG. 10*b* shows a schematic cross section through the rotatable pump wheel and the second blocking element of the locking system of the first embodiment of the case in engagement with the rotatable pump wheel.

In FIGS. 10*a* and 10*b*, a second blocking element 197 of the locking system 195 of the first embodiment of the case 200 is illustrated. In more detail, FIG. 10*a* shows a perspective view on a second blocking element 197 of the locking system 195 arranged adjacent to the rotatable pump wheel 125. FIG. 10*b* shows a cross section through the rotatable pump wheel 125 and the second blocking element 197 of the locking system 195 in engagement with the rotatable pump wheel. In this first embodiment, the locking system 195 further comprises a second blocking element 197 configured to prevent an actuation of the actuation element 130 of the pump system 120 when the connection interface 180 is in the second position. An advantage of that may be that an actuation of the pump system 120 is only enabled when the connection interface 180 is in the first position. When the connection interface 180 is in the second position and not connected to an electronic smoking device 10, 10*a* inserted into the primary receiving portion 101, the pump system 120 cannot be actuated which prevents a spilling of liquid. Furthermore, this prevents the actuation element 130/the rotatable pump wheel 125 from being unintentionally actuated, for example in the pocket of a user, as the actuation of the same is prevented when the connection interface 180 is in the second position and the case 200 is in a locked state. In more detail, in this first embodiment, the rotatable pump wheel 125 comprises a circular collar 127 that protrudes from a front side of the rotatable pump wheel 125, facing towards the secondary receiving portion 102, into a corresponding circular cavity provided within the retaining frame component 207 within the case 200. The circular collar 127 comprises a plurality of equidistant fixation holes for the reception of the second blocking element 197, which in this first embodiment comprises a rod that has a diameter which corresponds to the diameter of the fixation holes within the circular collar 127 respectively, allowing for the rod to be inserted into one of the fixation holes respectively. In this first embodiment, the rod is fixed within a frame component 198 which is arranged adjacent to the circular collar 127 of the rotatable pump wheel 125. The frame component 198 and the rod are configured slidable along respective cavities arranged within the case 200. The frame component 198 itself is fixed to the slide frame component 174 as shown in the FIGS. 3, 4, 8*a*, 10*a* and 10*b*. Thus, when the lever element 190 (see for example FIG. 4) is actuated, moving the connection interface 180 and the slide frame component 174 from the first position into the second position, the slide frame component 174 moves the frame component 198 into a position in that the second blocking element 197 is inserted into a corresponding fixation hole of the circular collar 127 of the rotatable pump wheel 125. In this position, the rotatable pump wheel 125 cannot be rotated as the rotation is blocked via the rod/the second blocking element 197. This position is shown in the FIGS. 10*a* and 10*b*, where the rod of the second blocking element 197 is in the inserted position. When the connection interface 180 together with the slide frame component 174 is moved from the second position to the first position, the rod is retracted from the respective fixation hole within the circular collar 127 of the rotatable pump wheel 125, thereby releasing the rotatable pump wheel 125, allowing for an actuation of the same and of the pump system 120. Thus, via the first and the second blocking element 196, 197, the case 200 is transferrable into a locked state and into an unlocked state.

Figure 11:
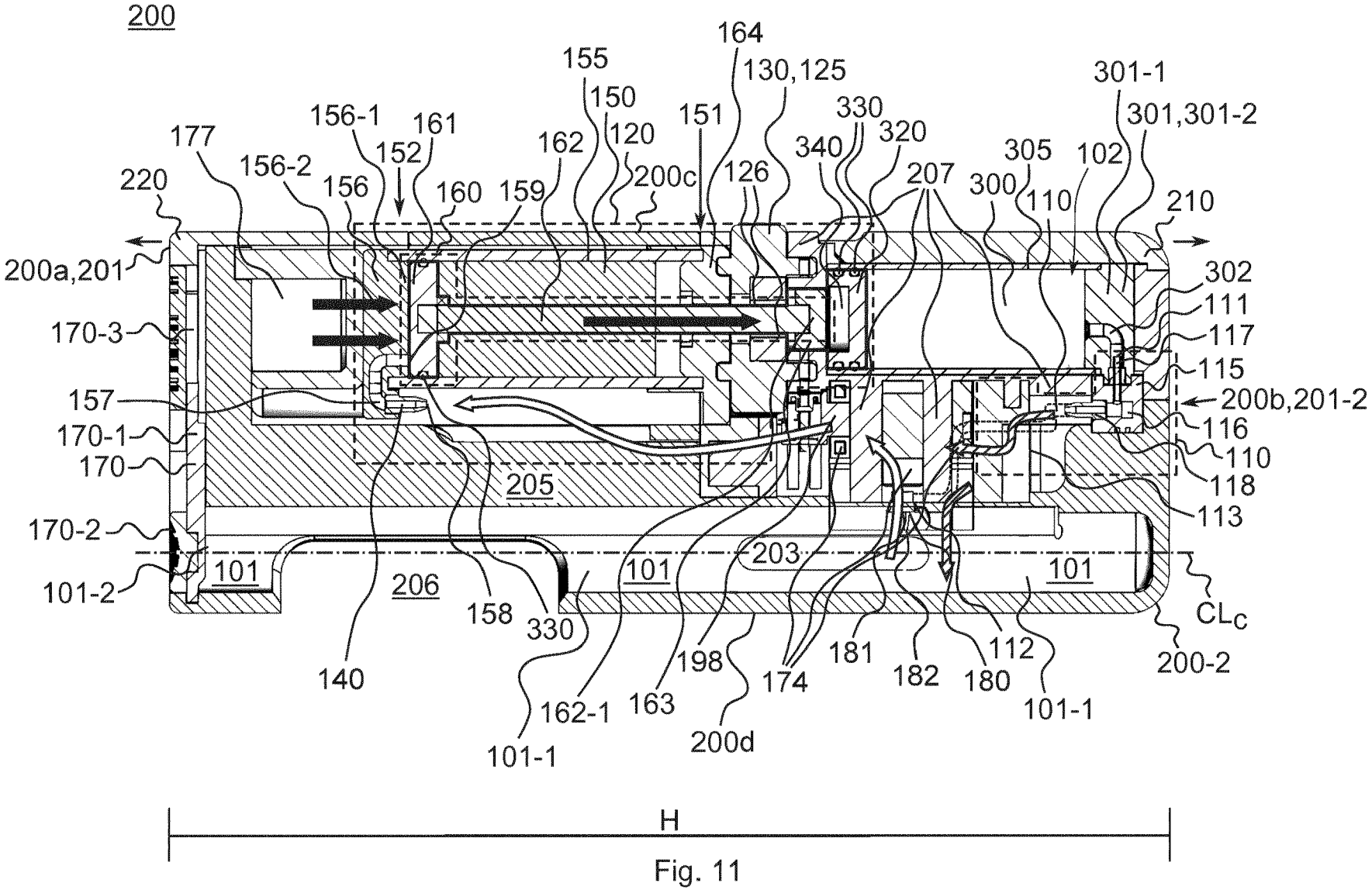
FIG. 11 shows a schematic cross-sectional illustration of the first embodiment of the case in a disassembled state in use.

In FIG. 11, it is shown a schematic cross-sectional illustration of the first embodiment of the case 200 in use. Also in FIG. 11, the case 200 is shown without the first part 200-1 of the case 200, only showing the lower half-shell of the same with the components of the case 200 arranged therein. In FIG. 11, the flow of liquid and air given within the case 200 when the same is in use is indicated by different arrows. The connection interface 180 is in the first position and connected with an outer refill interface 33 of an electronic smoking device 10, 10*a* (not shown) that is arranged within the primary receiving portion 101 (not shown). When the rotatable pump wheel 125 is rotated in a first direction, the plunger component 160 is screwed away from the reservoir cap 156 of the air suction reservoir 150 towards the cartridge cap 301 of the liquid cartridge 300, thereby pushing liquid contained within the liquid cartridge 300 of the case 200 out of the liquid outlet 112 of the liquid channel system 110 and into the second hollow needle element 182 of the connection interface 180. Since the second hollow needle element 182 is connected to the outer refill interface 33 of the electronic smoking device 10, 10*a*, liquid that is expelled from the second hollow needle element 182 directly flows into the liquid reservoir 34 of the electronic smoking device 10, 10*a*. In FIG. 11, the flow of liquid is indicated via hatched arrows.

The refilling of the liquid reservoir 34 of the electronic smoking device 10, 10*a* with liquid will cause air to be ousted out of the liquid reservoir 34 of the electronic smoking device 10, 10*a*. Since such ousted air can comprise drops of liquid, the air that is ousted out of the liquid reservoir 34 of the electronic smoking device 10, 10*a* is recaptured via the first hollow needle element 181 in order to avoid spilling of liquid. Via the air suction reservoir 150, the air is sucked through the first hollow needle element 181 and via the air channel component 141 connected to the first hollow needle element 181 into the air suction reservoir 150 when the plunger component 160 moves into the aforementioned direction. In FIG. 11, the flow of air is indicated by white arrows. The force applied by the support component 177 onto the reservoir cap 156 and the movement of the plunger component 160 are indicated via black arrows in FIG. 11.

Figure 12:
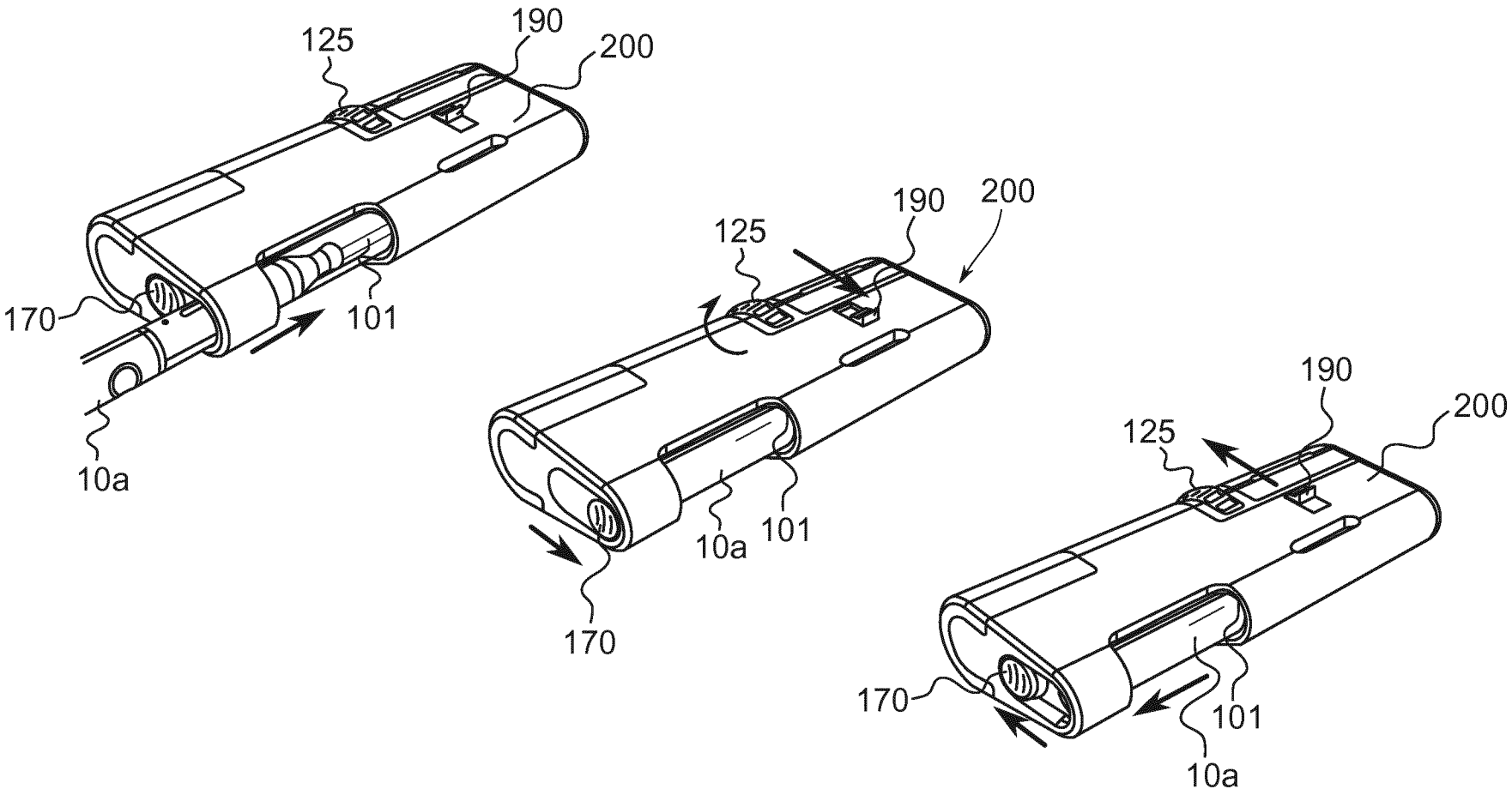
FIG. 12 shows a refill process of an electronic smoking device using the first embodiment of the case.

In FIG. 12, a refill process for the electronic smoking device 10*a* is shown, using the first embodiment of the case 200. On the left in FIG. 12, the case 200 is shown in a lying position. The slidable locking element 170 is in an opened position, allowing for the electronic smoking device 10*a* to be inserted into the primary receiving portion 101, which in the left illustration of FIG. 12 is indicated by an arrow.

When the electronic smoking device 10*a* (see FIG. 2) is fully inserted into the primary receiving portion 101, the slidable locking element 170 is slid into a closed position so that the electronic smoking device 10*a* is fixed within the case 200. The lever element 190 is actuated, bringing the connection interface 180 into the first position in which the connection interface 180 is connected to the outer refill interface 33 of the electronic smoking device 10*a*. When the connection interface 180 is in the first position, the rotatable pump wheel 125 of the pump system 120 is rotated, causing the liquid reservoir 34 of the electronic smoking device 10*a* to be refilled. In the middle of FIG. 12, the slide movement of the slidable locking element 170, the actuation of the lever element 190 and the rotation of the rotatable pump wheel 125 is indicated by arrows respectively.

As shown on the right in FIG. 12, the lever element 190 is actuated again when the liquid reservoir 34 of the electronic smoking device 10*a* is refilled and when the user wants to retract the electronic smoking device. The actuation of the lever element 190 will cause the connection interface 180 to be retracted from the primary receiving portion 101. Then, the slidable locking element 170 can be transferred into an open position and the electronic smoking device 10*a* can be extracted from the primary receiving portion 101 of the case 200, as also indicated on the right of FIG. 12 via arrows.

Figure 13:
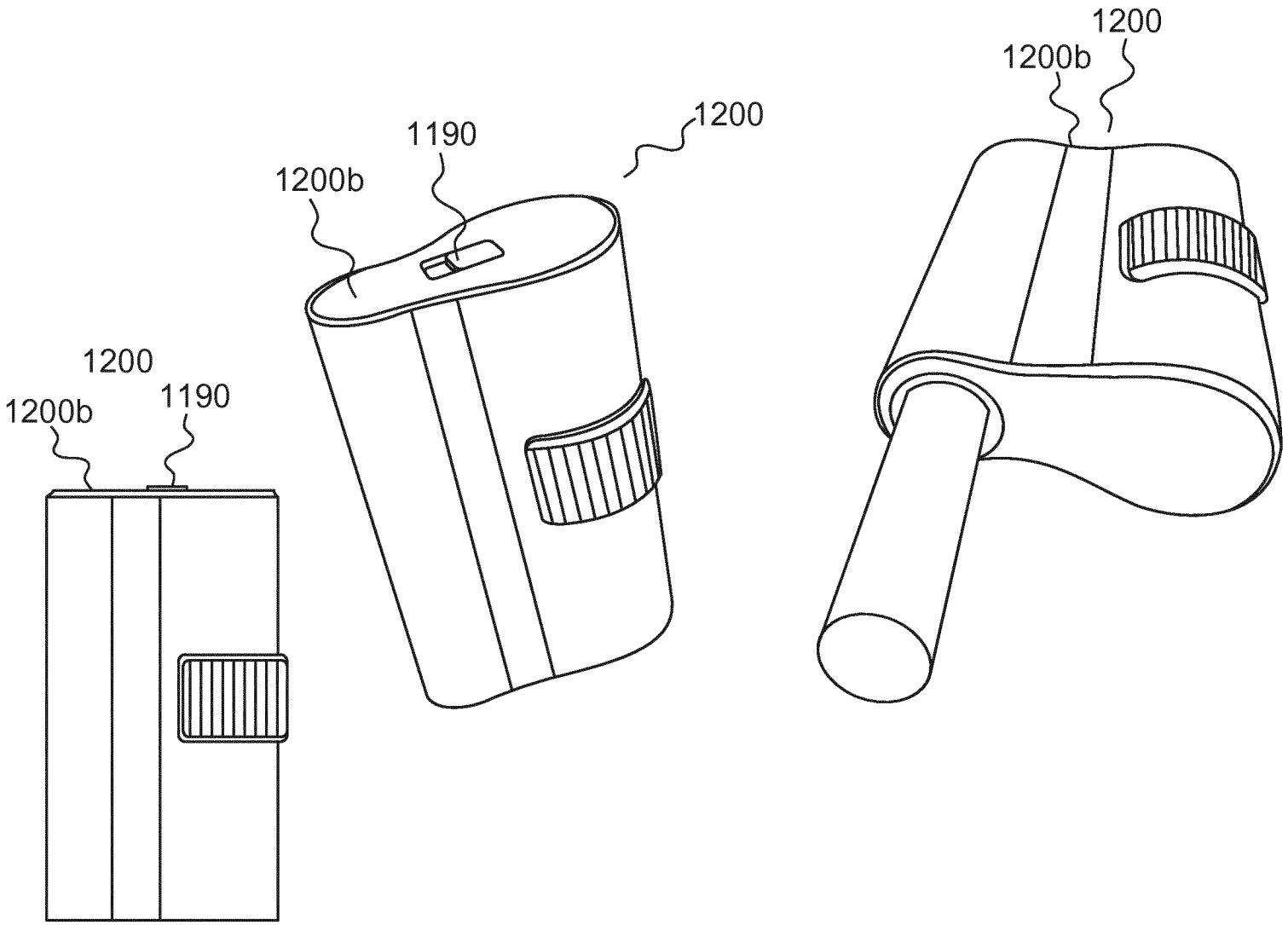
FIG. 13 shows a schematic illustration of a second embodiment of a case in three different perspectives.

In FIG. 13, a second embodiment of a case 1200 is shown in three different perspectives. The second embodiment of the case 1200 shown in FIG. 13 is substantially identical to the first embodiment as shown in the FIGS. 2 to 12. Thus, the internal components (not shown) of the case 1200 shown in FIG. 13 substantially have the same arrangement and function as the components described hereinbefore. In this second embodiment, the case 1200 has a slimmer contour which is space-saving. Furthermore, the rotatable pump wheel 1125 has a smaller diameter but a larger breadth than the rotatable pump wheel 125 of the first embodiment of the case 200. This provides the case 1200 with a more handy design. Furthermore, in the second embodiment, the lever element 1190 is arranged centrally within the upper sidewall 1200*b* of the case 1200, allowing for the connection interface (not shown in FIG. 13) of the second embodiment of the case 1200 to be moved between the first and the second position and to transfer the case 1200 into a locked state or into an unlocked state.

It is provided a case for an electronic smoking device. The case comprises a primary receiving portion, adapted to receive an electronic smoking device and a secondary receiving portion, adapted to receive a liquid cartridge, adapted to contain a liquid. Furthermore, the case comprises a liquid channel system for the transport of liquid within the case. The liquid channel system comprises a liquid inlet, adapted to be connected to a liquid cartridge received by the secondary receiving portion, a liquid outlet, and a liquid channel component, interconnecting the liquid inlet and the liquid outlet. Moreover, the case comprises a pump system with an actuation element, adapted to provide liquid from a liquid cartridge received by the secondary receiving portion to the liquid outlet via the liquid channel system upon an actuation of the actuation element.

An advantage of that may be that such a case allows for a safe and handy transport of an electronic smoking device while simultaneously enabling a refill of the liquid reservoir of the electronic smoking device received by the case via the pump system arranged within the case. Thus, the case is multifunctional and advantageously provides for an all-in-one transport and refill system.

Preferably, the pump system comprises an air channel system and an air suction reservoir arranged within the case, the air suction reservoir being connectable to an electronic smoking device received by the primary receiving portion via the air channel system. An advantage of that may be that the pump system can easily be used for a refill of the liquid reservoir of an electronic smoking device received by the primary receiving portion, wherein air that is ousted out of the liquid reservoir of the electronic smoking device is recaptured by the pump system, using the air suction reservoir. Since air that is ousted out of the liquid reservoir of an electronic smoking device that is refilled often comprises liquid drops, the refilling procedure enabled by the pump system allows for a refill of the liquid reservoir of an electronic smoking device without that liquid is spilled.

In a preferred embodiment, the air suction reservoir comprises a plunger component, the plunger component having a plunger that is arranged movably within the air suction reservoir and a threaded rod attached to the plunger, wherein the threaded rod is protruding from a front portion of the air suction reservoir, wherein the front portion is facing the secondary receiving portion. An advantage of that may be that such a plunger component on the one hand allows for an improved suction of air, providing for an air-tight connection between the plunger and the inner sides of the outer reservoir wall of the air suction reservoir which enables the generation of an over- or underpressure within the air suction reservoir. On the other hand, such a plunger component simultaneously allows to push liquid out of the liquid cartridge via the cartridge outlet.

Preferably, the actuation element comprises a rotatable pump wheel with an internal screw thread arranged in engagement with the threaded rod, wherein the threaded rod with the plunger attached thereto is pulled or pushed within the air suction reservoir depending on the direction of rotation of the rotatable pump wheel. An advantage of that may be that such a rotatable pump wheel allows for an eased actuation of the pump system in order to provide liquid from a liquid cartridge arranged within the secondary receiving portion to an electronic smoking device received by the primary receiving portion. Furthermore, the rotatable pump wheel can be actuated by a user himself and is not dependent on an internal or an external power source.

In a preferred embodiment, the case further comprises a liquid cartridge received by the secondary receiving portion. The liquid cartridge comprises a cartridge outlet, connected to the liquid inlet, and an integrated slider portion which is configured slidable along the inner sides of the walls of the liquid cartridge, the integrated slider portion being arranged and configured to be moved by a front portion of the threaded rod protruding from the air suction reservoir. An advantage of that may be that the case itself does not need to be refilled with a liquid, which is complicated and may cause the liquid to be spilled during the refill procedure. Instead, a liquid cartridge containing the liquid easily can be inserted into the secondary receiving portion, which is safer and cleaner.

Preferably, the integrated slider portion and/or the plunger comprises at least one ring-shaped gasket element. An advantage of that may be that such a ring-shaped gasket element allows for an air-tight division of the air-suction reservoir or the liquid cartridge into a first and a second chamber. This enables the suction of air via the air suction reservoir that has the structure and functionality of a syringe. Furthermore, this enables the efficient expel of liquid out of the cartridge outlet of the liquid cartridge.

In a preferred embodiment, the primary receiving portion comprises an elongated cavity, adapted to enclose an electronic smoking device along its entire length L, the cavity comprising a primary opening on a first side of the case, wherein the primary opening is closeable via a slidable locking element arranged on or adjacent to the first side of the case. An advantage of such a case may be that an electronic smoking device safely can be stored within the case without that the electronic smoking device is rattling within the case.

Preferably, the case further comprises a connection interface connectable to the liquid outlet of the liquid channel system, wherein the connection interface is configured movably between a first and a second position, the connection interface comprising a first and a second hollow needle element, each adapted to be inserted into a corresponding refill interface of an electronic smoking device received by the primary receiving portion. An advantage of that may be that the connection between the case and an electronic smoking device that is inserted into the primary receiving portion in order to refill the liquid reservoir of the electronic smoking device is eased. Thus, via the moveable connection interface, the electronic smoking device or a liquid reservoir thereof can easily be connected to the liquid channel system and thereby to the liquid cartridge.

In a preferred embodiment, the first hollow needle element is connected to the air channel system, adapted to transport air from the first hollow needle element to the air suction reservoir. An advantage of that may be that air which is ousted out of the liquid reservoir of an electronic smoking device during a refill process of the same will reliably be transported from the liquid reservoir of the electronic smoking device into the air suction reservoir of the case via the first hollow needle element of the connection interface.

Preferably, a flow of liquid from the liquid inlet of the liquid channel system to the second hollow needle element is enabled when the connection interface is in the first position and wherein the flow of liquid from the liquid inlet of the liquid channel system to the second hollow needle element is reduced or interrupted when the connection interface is in the second position. Furthermore preferred, a flow of liquid from the liquid inlet of the liquid channel system to the second hollow needle element is enabled to a first extent when the connection interface is in the first position and wherein the flow of liquid from the liquid inlet of the liquid channel system to the second hollow needle element is enabled to a second extent when the connection interface is in the second position, wherein a flow of liquid enabled to the second extent is smaller than a flow of liquid enabled to the first extent. An advantage of that may be that liquid cannot be expelled via the second hollow needle element when the connection interface is in the second position. Expressed in other words, in this first embodiment, liquid can only be expelled via the second hollow needle element when the connection interface is in the first position. This will efficiently prevent a spilling of liquid. Furthermore, the flow of liquid at the liquid outlet and therefore the liquid channel system of the case is blocked when the connection interface is not protruding into the primary receiving portion and especially when it is not connected to an electronic smoking device inserted into the primary receiving portion.

In a preferred embodiment, the first and the second needle element protrude into the primary receiving portion when the connection interface is in the first position and wherein the first and the second needle element are retracted from the primary receiving portion when the connection interface is in the second position. An advantage of that may be that the insertion of an electronic smoking device into the primary receiving portion of the case is eased, as in the second position, no element or component of the case protrudes into the primary receiving portion of the case so that the electronic smoking device can easily be slid into the primary receiving portion.

Preferably, the case further comprises a lever element that is connected to the connection interface and accessible from outside of the case, wherein the connection interface is moveable between the first and the second position upon an actuation of the lever element. An advantage of that may be that a movement of the connection interface within the case can easily be performed via an actuation of the lever element protruding out of the case.

In a preferred embodiment, the case further comprises a locking system, the locking system being coupled to the lever element and adapted to prevent or reduce a supply of liquid to the second hollow needle element of the connection interface when the connection interface is in the second position. An advantage of that may be that liquid is not transported to the second hollow needle element when the connection interface is in the second position. In order to allow for liquid to flow from a liquid cartridge inserted into the secondary receiving portion to the second hollow needle element, the connection interface needs to be moved to the first position. Therefore, via the locking system, spilling of liquid is further prevented.

Preferably, the locking system comprises a first blocking element, the first blocking element being adapted to interact with the liquid channel component when the connection interface is in the second position, thereby blocking a flow of liquid to the second needle element. An advantage of that may be that the first blocking element physically blocks the liquid channel component and interrupts the flow of liquid, which safely prevents a spilling of liquid, for example when the electronic smoking device is removed from the primary receiving portion.

In a preferred embodiment, the locking system further comprises a second blocking element configured to prevent an actuation of the actuation element of the pump system when the connection interface is in the second position. An advantage of that may be that an actuation of the pump system is only enabled when the connection interface is in the first position. When the connection interface is in the second position and not connected to an electronic smoking device inserted into the primary receiving portion, the pump system cannot be actuated which further prevents a spilling of liquid. In such an embodiment of the case, comprising the first and the second blocking element, not only liquid cannot flow through the liquid channel system, also the pump system itself is blocked. Thus, in such an embodiment, an unintentional spilling of liquid is safely prevented. Furthermore, this prevents the actuation element/the rotatable pump wheel from being unintentionally actuated, for example in the pocket of a user, as the actuation of the same is prevented when the connection interface is in the second position and the case is in a locked state.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

10, 10*a* electronic smoking device
12 power supply portion
14 atomizer/liquid reservoir portion
16 end cap
18 battery
20 light-emitting diode (LED)
22 control electronics
24 airflow sensor
26 atomizer
28 heating coil
30 wick
32 central passage
33 outer refill interface
33-1 first separate opening
33-2 second separate opening
34 liquid reservoir
36 air inhalation port
38 air inlets
39 mouthpiece
101 primary receiving portion
101-1 elongated cavity
101-2 primary opening

102 secondary receiving portion
110 liquid channel system
111 liquid inlet
112 liquid outlet
113 liquid channel component
115 cartridge interface element
116 interface element channel
117 cartridge needle
118 nozzle connection piece
120 pump system
125, 1125 rotatable pump wheel
126 internal screw thread
127 circular collar
130 actuation element
140 air channel system
141 air channel component
150 air suction reservoir
151 front portion of the air suction reservoir
152 back portion of the air suction reservoir
155 reservoir wall
156 reservoir cap
156-1 first cylindrical portion
156-2 second cylindrical portion
157 reservoir cap channel
158 air inlet
159 reservoir cap outlet
160 plunger component
161 plunger
162 threaded rod
162-1 front end of the threaded rod
163 cap element
164 stopper element
170 slidable locking element
170-1 slide plate
170-2 knob
170-3 slide cavity
174 slide frame component
175 guide rail component
175-1 first guide rail cavity
175-2 second guide rail cavity
177 support component
180 connection interface
180-1 back side of the box-shaped, rectangular body of the connection interface
180-2 front side of the box-shaped, rectangular body of the connection interface
180-3 top side of the box-shaped, rectangular body of the connection interface
180-4 bottom side of the box-shaped, rectangular body of the connection interface
180-5 first side wall of the box-shaped, rectangular body of the connection interface
180-6 second side wall of the box-shaped, rectangular body of the connection interface
181 first hollow needle element
182 second hollow needle element
183 first circular cavity within the connection interface
184 second circular cavity within the connection interface
190, 1190 lever element
190-1 first lever component
190-2 second lever component
195 locking system
196 first blocking element
196-1 plate-shaped base part of the first blocking element
196-2 protrusion of the first blocking element
197 second blocking element
198 frame component
200, 1200 case
200*a* lower sidewall
200*b*, 1200*b* upper sidewall
200*c* side wall on the wide side of the case
200*d* side wall on the narrow side of the case
200*e* side wall on the front side of the case
200*f* side wall on the back side of the case
200-1 first part of the case
200-2 second part of the case
201 first side of the case
201-2 second side of the case
202 first slit-shaped window
203 second slit-shaped window
205 internal retaining wall
206 manipulation cavity
207 retaining frame component
210 upper corner part
220 lower corner part
300 liquid cartridge
301 cartridge cap
301-1 first cylinder/cylindrical portion of the cartridge cap
301-2 second cylinder/cylindrical portion of the cartridge cap
302 cartridge cap channel
303 cartridge cap inlet
305 walls of the liquid cartridge
310 cartridge outlet
320 integrated slider portion
330 ring-shaped gasket element
340 reception cavity
CL centerline of the electronic smoking device
CLc central axis of the elongated cavity
La line
L length of the electronic smoking device
H height of the case

The invention claimed is:

1. A case for an electronic smoking device, the case comprising:
- a primary receiving portion, adapted to receive an electronic smoking device;
- a secondary receiving portion, adapted to receive a liquid cartridge, adapted to contain a liquid;
- a liquid channel system for the transport of liquid within the case, the liquid channel system comprising
  - a liquid inlet, adapted to be connected to a liquid cartridge received by the secondary receiving portion,
  - a liquid outlet, and
  - a liquid channel component, interconnecting the liquid inlet and the liquid outlet;
- a pump system with an actuation element, wherein the actuation element comprises a rotatable pump wheel being accessible from an outside of the case and is adapted to provide liquid from a liquid cartridge received by the secondary receiving portion to the liquid outlet via the liquid channel system upon an actuation of the actuation element.

2. The case of claim 1, wherein the pump system comprises an air channel system and an air suction reservoir arranged within the case, the air suction reservoir being connectable to an electronic smoking device received by the primary receiving portion via the air channel system.

3. The case of claim 2, wherein the air suction reservoir comprises a plunger component, the plunger component having a plunger that is arranged movably within the air suction reservoir and a threaded rod attached to the plunger, wherein the threaded rod is protruding from a front portion of the air suction reservoir, wherein the front portion is facing the secondary receiving portion.

4. The case of claim 3, wherein the rotatable pump wheel comprises an internal screw thread arranged in engagement with the threaded rod, wherein the threaded rod with the plunger attached thereto is pulled or pushed within the air suction reservoir depending on the direction of rotation of the rotatable pump wheel.

5. The case of claim 4, further comprising a liquid cartridge received by the secondary receiving portion, the liquid cartridge comprising a cartridge outlet, connected to the liquid inlet, and an integrated slider portion which is configured slidable along the inner sides of the walls of the liquid cartridge, the integrated slider portion being arranged and configured to be moved by a front portion of the threaded rod protruding from the air suction reservoir.

6. The case of claim 5, wherein the integrated slider portion and/or the plunger comprises at least one ring-shaped gasket element.

7. The case of claim 1, wherein the primary receiving portion comprises an elongated cavity, adapted to enclose an electronic smoking device along its entire length L, the cavity comprising a primary opening on a first side of the case, wherein the primary opening is closeable via a slidable locking element arranged on or adjacent to the first side of the case.

8. The case of claim 2, further comprising a connection interface connectable to the liquid outlet of the liquid channel system, wherein the connection interface is configured movably between a first and a second position, the connection interface comprising a first and a second hollow needle element, each adapted to be inserted into a corresponding refill interface of an electronic smoking device received by the primary receiving portion.

9. The case of claim 8, wherein the first hollow needle element is connected to the air channel system, adapted to transport air from the first hollow needle element to the air suction reservoir.

10. The case of claim 8, wherein a flow of liquid from the liquid inlet of the liquid channel system to the second hollow needle element is enabled when the connection interface is in the first position and wherein the flow of liquid from the liquid inlet of the liquid channel system to the second hollow needle element is reduced or interrupted when the connection interface is in the second position.

11. The case of claim 8, wherein the first and the second needle element protrude into the primary receiving portion when the connection interface is in the first position and wherein the first and the second needle element are retracted from the primary receiving portion when the connection interface is in the second position.

12. The case of claim 8, further comprising a lever element that is connected to the connection interface and accessible from outside of the case, wherein the connection interface is moveable between the first and the second position upon an actuation of the lever element.

13. The case of claim 12, further comprising a locking system, the locking system being coupled to the lever element and adapted to prevent or reduce a supply of liquid to the second hollow needle element of the connection interface when the connection interface is in the second position.

14. The case of claim 13, wherein the locking system comprises a first blocking element, the first blocking element being adapted to interact with the liquid channel component when the connection interface is in the second position, thereby blocking a flow of liquid to the second needle element.

15. The case of claim 13, wherein the locking system further comprises a second blocking element configured to prevent an actuation of the actuation element of the pump system when the connection interface is in the second position.

* * * * *